US006629869B1

(12) United States Patent
Kumar et al.

(10) Patent No.: US 6,629,869 B1
(45) **Date of Patent: *Oct. 7, 2003**

(54) METHOD OF MAKING FLAT PANEL DISPLAYS HAVING DIAMOND THIN FILM CATHODE

(75) Inventors: Nalin Kumar, Austin, TX (US); Chenggang Xie, Cedar Park, TX (US)

(73) Assignee: SI Diamond Technology, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/474,277

(22) Filed: Jun. 7, 1995

Related U.S. Application Data

(63) Continuation of application No. 08/326,302, filed on Oct. 19, 1994, now Pat. No. 5,551,903, which is a division of application No. 08/300,771, filed on Jun. 20, 1994, which is a continuation of application No. 07/851,701, filed on Mar. 16, 1992, now abandoned.

(51) Int. Cl.[7] ..... H01J 9/02
(52) U.S. Cl. ..... 445/24; 445/50
(58) Field of Search ..... 445/24, 50, 51

(56) References Cited

U.S. PATENT DOCUMENTS

| | | | |
|---|---|---|---|
| 1,954,691 | A | 4/1934 | de Boer et al. |
| 2,851,408 | A | 9/1958 | Cerulli et al. |
| 2,867,541 | A | 1/1959 | Coghill et al. |
| 2,959,483 | A | 11/1960 | Kaplan |
| 3,070,441 | A | 12/1962 | Schwartz |
| 3,108,904 | A | 10/1963 | Cusano |
| 3,259,782 | A | 7/1966 | Shroff |
| 3,314,871 | A | 4/1967 | Heck et al. |
| 3,360,450 | A | 12/1967 | Hays |
| 3,481,733 | A | 12/1969 | Evans |
| 3,525,679 | A | 8/1970 | Wilcox et al. |
| 3,554,889 | A | 1/1971 | Hyman et al. |
| 3,665,241 | A | 5/1972 | Spindt et al. |
| 3,675,063 | A | 7/1972 | Spindt et al. |
| 3,755,704 | A | 8/1973 | Spindt et al. |
| 3,789,471 | A | 2/1974 | Spindt et al. |
| 3,808,048 | A | 4/1974 | Strik |

(List continued on next page.)

FOREIGN PATENT DOCUMENTS

| | | |
|---|---|---|
| FR | 88 07288 | 12/1989 |
| JP | 57-141480 | 9/1982 |

(List continued on next page.)

OTHER PUBLICATIONS

Himpsel et al. "Quantum photoyield of Diamond (III)–A stable negative affinity emitter" Phys. Rev. B. 20 pp 624–627 (1979).*

Xu et al. J. Phys. D. Appl. Phys., pp 1776–1780 (1993).*

Kang et al., Application of Diamond Films and Related Materials Third International Conference. pp 37–40 (1995).*

Ralchenko et al "A Technique for Controllable Seeding of Ultrafine Diamond Particles for Growth and Selective–Area Deposition of Diamond Films," *2nd International Conference on the Applications of Diamond Films and Related Materials*, 1993, pp. 475–480.

(List continued on next page.)

*Primary Examiner*—Kenneth J. Ramsey
(74) *Attorney, Agent, or Firm*—Kelly K. Kordzik; Winstead Sechrest & Minick P.C.

(57) ABSTRACT

A field emission cathode is provided which includes a substrate and a conductive layer desposed adjacent the substrate. An electrically resistive pillar is disposed adjacent the conductive layer, the resistive pillar having a substantially flat surface spaced from and substantially parallel to the substrate. A layer of diamond is disposed adjacent the surface of the resistive pillar.

5 Claims, 13 Drawing Sheets

U.S. PATENT DOCUMENTS

| | | | | |
|---|---|---|---|---|
| 3,812,559 | A | | 5/1974 | Spindt et al. |
| 3,855,499 | A | | 12/1974 | Yamada et al. |
| 3,898,146 | A | | 8/1975 | Rehkopf et al. |
| 3,947,716 | A | | 3/1976 | Fraser, Jr. et al. |
| 3,970,887 | A | | 7/1976 | Smith et al. |
| 3,998,678 | A | | 12/1976 | Fukase et al. |
| 4,008,412 | A | | 2/1977 | Yuito et al. |
| 4,075,535 | A | | 2/1978 | Genequand et al. |
| 4,084,942 | A | | 4/1978 | Villalobos |
| 4,139,773 | A | | 2/1979 | Swanson |
| 4,141,405 | A | | 2/1979 | Spindt |
| 4,143,292 | A | | 3/1979 | Hosoki et al. |
| 4,164,680 | A | | 8/1979 | Villalobos |
| 4,168,213 | A | | 9/1979 | Hoeberechts |
| 4,178,531 | A | | 12/1979 | Alig |
| 4,183,125 | A | * | 1/1980 | Meyer et al. ..... 445/24 |
| 4,307,507 | A | | 12/1981 | Gray et al. |
| 4,350,926 | A | | 9/1982 | Shelton |
| 4,482,447 | A | | 11/1984 | Mizuguchi et al. |
| 4,498,952 | A | | 2/1985 | Christensen |
| 4,507,562 | A | | 3/1985 | Gasiot et al. |
| 4,512,912 | A | | 4/1985 | Matsuda et al. |
| 4,513,308 | A | | 4/1985 | Greene et al. |
| 4,540,983 | A | | 9/1985 | Morimoto et al. |
| 4,542,038 | A | | 9/1985 | Odaka et al. |
| 4,578,614 | A | | 3/1986 | Gray et al. |
| 4,588,921 | A | | 5/1986 | Tischer |
| 4,594,527 | A | | 6/1986 | Genevese |
| 4,633,131 | A | | 12/1986 | Khurgin |
| 4,647,400 | A | | 3/1987 | Dubroca et al. |
| 4,663,559 | A | | 5/1987 | Christensen |
| 4,684,353 | A | | 8/1987 | deSouza |
| 4,684,540 | A | | 8/1987 | Schulze |
| 4,685,996 | A | | 8/1987 | Busta et al. |
| 4,687,825 | A | | 8/1987 | Sagou et al. |
| 4,687,938 | A | | 8/1987 | Tamura et al. |
| 4,710,765 | A | | 12/1987 | Ohkoshi et al. |
| 4,721,885 | A | | 1/1988 | Brodie |
| 4,728,851 | A | | 3/1988 | Lambe |
| 4,758,449 | A | | 7/1988 | Kimura et al. |
| 4,763,187 | A | | 8/1988 | Biberian |
| 4,780,684 | A | | 10/1988 | Kosmahl |
| 4,788,472 | A | | 11/1988 | Katakami |
| 4,816,717 | A | | 3/1989 | Harper et al. |
| 4,818,914 | A | | 4/1989 | Brodie |
| 4,822,466 | A | | 4/1989 | Rabalais et al. |
| 4,827,177 | A | | 5/1989 | Lee et al. |
| 4,835,438 | A | | 5/1989 | Baptist et al. |
| 4,851,254 | A | | 7/1989 | Yamamoto et al. |
| 4,855,636 | A | | 8/1989 | Busta et al. |
| 4,857,161 | A | | 8/1989 | Borel et al. |
| 4,857,799 | A | | 8/1989 | Spindt et al. |
| 4,874,981 | A | | 10/1989 | Spindt |
| 4,882,659 | A | | 11/1989 | Gloudemans |
| 4,889,690 | A | | 12/1989 | Opitz et al. |
| 4,892,757 | A | | 1/1990 | Kasenga et al. |
| 4,899,081 | A | | 2/1990 | Kishino et al. |
| 4,900,584 | A | | 2/1990 | Tuenge et al. |
| 4,908,539 | A | | 3/1990 | Meyer |
| 4,923,421 | A | | 5/1990 | Brodie et al. |
| 4,926,056 | A | | 5/1990 | Spindt |
| 4,933,108 | A | | 6/1990 | Soredal |
| 4,940,916 | A | | 7/1990 | Borel et al. |
| 4,943,343 | A | | 7/1990 | Bardai et al. |
| 4,956,202 | A | | 9/1990 | Kasenga et al. |
| 4,956,574 | A | | 9/1990 | Kane |
| 4,964,946 | A | | 10/1990 | Gray et al. |
| 4,987,007 | A | | 1/1991 | Wagal et al. |
| 4,990,416 | A | | 2/1991 | Mooney |
| 4,990,766 | A | | 2/1991 | Simms et al. |
| 4,994,205 | A | | 2/1991 | Bryan et al. |
| 5,007,873 | A | | 4/1991 | Goronkin et al. |
| 5,015,912 | A | | 5/1991 | Spindt et al. |
| 5,019,003 | A | | 5/1991 | Chason |
| 5,036,247 | A | | 7/1991 | Watanabe et al. |
| 5,038,070 | A | | 8/1991 | Bardai et al. |
| 5,043,715 | A | | 8/1991 | Kun et al. |
| 5,054,046 | A | | 10/1991 | Shoulders |
| 5,054,047 | A | | 10/1991 | Shoulders |
| 5,055,077 | A | | 10/1991 | Kane |
| 5,055,744 | A | | 10/1991 | Tsuruoka |
| 5,057,047 | A | | 10/1991 | Greene et al. |
| 5,063,323 | A | | 11/1991 | Longo et al. |
| 5,063,327 | A | | 11/1991 | Brodie et al. |
| 5,064,396 | A | | 11/1991 | Spindt |
| 5,066,883 | A | | 11/1991 | Yoshioka et al. |
| 5,075,591 | A | | 12/1991 | Holmberg |
| 5,075,595 | A | | 12/1991 | Kane |
| 5,075,596 | A | | 12/1991 | Young et al. |
| 5,079,476 | A | | 1/1992 | Kane |
| 5,085,958 | A | | 2/1992 | Jeong |
| 5,089,292 | A | | 2/1992 | MaCaulay et al. |
| 5,089,742 | A | | 2/1992 | Kirkpatrick et al. |
| 5,089,812 | A | | 2/1992 | Fuse |
| 5,090,932 | A | | 2/1992 | Dieumegard et al. |
| 5,098,737 | A | | 3/1992 | Collins et al. |
| 5,101,137 | A | | 3/1992 | Kun et al. |
| 5,101,288 | A | | 3/1992 | Ohta et al. |
| 5,103,144 | A | | 4/1992 | Dunham |
| 5,103,145 | A | | 4/1992 | Doran |
| 5,117,267 | A | | 5/1992 | Kimoto et al. |
| 5,117,299 | A | | 5/1992 | Kondo et al. |
| 5,119,386 | A | | 6/1992 | Narusawa |
| 5,123,039 | A | | 6/1992 | Shoulders |
| 5,124,072 | A | | 6/1992 | Dole et al. |
| 5,124,558 | A | | 6/1992 | Soltani et al. |
| 5,126,287 | A | | 6/1992 | Jones |
| 5,129,850 | A | | 7/1992 | Kane et al. |
| 5,132,585 | A | | 7/1992 | Kane et al. |
| 5,132,676 | A | | 7/1992 | Kimura et al. |
| 5,136,764 | A | | 8/1992 | Vasquez |
| 5,138,237 | A | | 8/1992 | Kane et al. |
| 5,140,219 | A | | 8/1992 | Kane |
| 5,141,459 | A | | 8/1992 | Zimmerman |
| 5,141,460 | A | | 8/1992 | Jaskie et al. |
| 5,142,184 | A | | 8/1992 | Kane |
| 5,142,256 | A | | 8/1992 | Kane |
| 5,142,390 | A | | 8/1992 | Ohta et al. |
| 5,144,191 | A | | 9/1992 | Jones et al. |
| 5,148,078 | A | | 9/1992 | Kane |
| 5,148,461 | A | | 9/1992 | Shoulders |
| 5,150,011 | A | | 9/1992 | Fujieda |
| 5,150,192 | A | | 9/1992 | Greene et al. |
| 5,151,061 | A | | 9/1992 | Sandhu |
| 5,153,753 | A | | 10/1992 | Ohta et al. |
| 5,153,901 | A | | 10/1992 | Shoulders |
| 5,155,420 | A | | 10/1992 | Smith |
| 5,156,770 | A | | 10/1992 | Wetzel et al. |
| 5,157,304 | A | | 10/1992 | Kane et al. |
| 5,157,309 | A | | 10/1992 | Parker et al. |
| 5,162,704 | A | | 11/1992 | Kobori et al. |
| 5,166,456 | A | | 11/1992 | Yoshino |
| 5,173,634 | A | | 12/1992 | Kane |
| 5,173,635 | A | | 12/1992 | Kane |
| 5,173,697 | A | | 12/1992 | Smith et al. |
| 5,180,951 | A | | 1/1993 | Dworsky et al. |
| 5,183,529 | A | | 2/1993 | Potter et al. |
| 5,185,178 | A | | 2/1993 | Koskenmaki |
| 5,186,670 | A | | 2/1993 | Doan et al. |
| 5,187,578 | A | | 2/1993 | Kohgami et al. |
| 5,191,217 | A | | 3/1993 | Kane et al. |

| | | | |
|---|---|---|---|
| 5,192,240 | A | 3/1993 | Komatsu |
| 5,194,780 | A | 3/1993 | Meyer |
| 5,199,917 | A | 4/1993 | MacDonald et al. |
| 5,199,918 | A | 4/1993 | Kumar |
| 5,201,992 | A | 4/1993 | Andreadakis et al. |
| 5,202,571 | A | 4/1993 | Hinabayashi et al. |
| 5,203,731 | A | 4/1993 | Zimmerman |
| 5,204,021 | A | 4/1993 | Dole |
| 5,204,581 | A | 4/1993 | Andreadakis et al. |
| 5,205,770 | A | 4/1993 | Lowrey et al. |
| 5,209,687 | A | 5/1993 | Konishi |
| 5,210,430 | A | 5/1993 | Taniguchi et al. |
| 5,210,462 | A | 5/1993 | Konishi |
| 5,212,426 | A | 5/1993 | Kane |
| 5,213,712 | A | 5/1993 | Dole |
| 5,214,346 | A | 5/1993 | Komatsu |
| 5,214,347 | A | 5/1993 | Gray |
| 5,214,416 | A | 5/1993 | Kondo et al. |
| 5,220,725 | A | 6/1993 | Chan et al. |
| 5,227,699 | A | 7/1993 | Busta |
| 5,228,877 | A | 7/1993 | Allaway et al. |
| 5,228,878 | A | 7/1993 | Komatsu |
| 5,229,331 | A | 7/1993 | Doan et al. |
| 5,229,682 | A | 7/1993 | Komatsu |
| 5,231,606 | A | 7/1993 | Gray |
| 5,232,549 | A | 8/1993 | Cathey et al. |
| 5,233,263 | A | 8/1993 | Cronin et al. |
| 5,235,244 | A | 8/1993 | Spindt |
| 5,236,545 | A | 8/1993 | Pryor |
| 5,242,620 | A | 9/1993 | Dole et al. |
| 5,243,252 | A | 9/1993 | Kaneko et al. |
| 5,250,451 | A | 10/1993 | Chouan |
| 5,252,833 | A | 10/1993 | Kane et al. |
| 5,256,888 | A | 10/1993 | Kane |
| 5,259,799 | A | 11/1993 | Doan et al. |
| 5,262,698 | A | 11/1993 | Dunham |
| 5,266,155 | A | 11/1993 | Gray |
| 5,275,967 | A | 1/1994 | Taniguchi et al. |
| 5,276,521 | A | 1/1994 | Mori |
| 5,277,638 | A | 1/1994 | Lee |
| 5,278,475 | A | 1/1994 | Jaskie et al. |
| 5,281,890 | A | 1/1994 | Kane |
| 5,281,891 | A | 1/1994 | Kaneko et al. |
| 5,283,500 | A | 2/1994 | Kochanski |
| 5,285,129 | A | 2/1994 | Takeda et al. |
| 5,296,117 | A | 3/1994 | De Jaeger et al. |
| 5,300,862 | A | 4/1994 | Parker et al. |
| 5,302,423 | A | 4/1994 | Tran et al. |
| 5,308,439 | A | 5/1994 | Cronin et al. |
| 5,312,514 | A | 5/1994 | Kumar |
| 5,312,777 | A | 5/1994 | Cronin et al. |
| 5,315,393 | A | 5/1994 | Mican |
| 5,329,207 | A | 7/1994 | Cathey et al. |
| 5,330,879 | A | 7/1994 | Dennison |
| 5,341,063 | A | 8/1994 | Kumar |
| 5,347,201 | A | 9/1994 | Liang et al. |
| 5,347,292 | A | 9/1994 | Ge et al. |
| 5,357,172 | A | 10/1994 | Lee et al. |
| 5,368,681 | A | 11/1994 | Hiraoka et al. |
| 5,378,963 | A | 1/1995 | Ikeda |
| 5,380,546 | A | 1/1995 | Krishnan et al. |
| 5,387,844 | A | 2/1995 | Browning |
| 5,393,647 | A | 2/1995 | Neukermans et al. |
| 5,396,150 | A | 3/1995 | Wu et al. |
| 5,399,238 | A | 3/1995 | Kumar |
| 5,401,676 | A | 3/1995 | Lee |
| 5,402,041 | A | 3/1995 | Kishino et al. |
| 5,404,070 | A | 4/1995 | Tsai et al. |
| 5,408,161 | A | 4/1995 | Kishino et al. |
| 5,410,218 | A | 4/1995 | Hush |
| 5,412,285 | A | 5/1995 | Komatsu |

FOREIGN PATENT DOCUMENTS

| | | |
|---|---|---|
| JP | 57-141482 | 9/1982 |
| JP | 58-102444 | 6/1983 |
| JP | 58-164133 | 9/1983 |
| JP | 59-075547 | 4/1984 |
| JP | 59-075548 | 4/1984 |
| JP | 59-209249 | 11/1984 |
| JP | 60-009039 | 1/1985 |
| JP | 60-049553 | 3/1985 |
| JP | 60-115682 | 6/1985 |
| JP | 62-027486 | 2/1987 |
| JP | 62-121783 | 6/1987 |
| JP | 63-251491 | 10/1988 |
| JP | 64-043595 | 2/1989 |
| JP | 3-119640 | 5/1991 |
| JP | 3-127431 | 5/1991 |
| JP | 3-137190 | 6/1991 |
| JP | 4-202493 | 7/1992 |
| JP | 4-227678 | 8/1992 |
| JP | 4-227785 | 8/1992 |
| JP | 4-230996 | 8/1992 |
| JP | 4-233991 | 8/1992 |
| JP | 4-270783 | 9/1992 |
| JP | 5-065478 | 3/1993 |
| JP | 5-117653 | 5/1993 |
| JP | 5-117655 | 5/1993 |

OTHER PUBLICATIONS van der Weide et al "Angle–resolved photoemission of diamond (111) and (100) surfaces; negative electron affinity and band structure measurements," *J. Vac. Sci. Technol. B*, vol. 12, No. 4, Jul./Aug. 1994, pp. 2475–2479.

van der Weide et al. "Argon and hydrogen plasma interactions on diamond (111) surfaces: Electronic states and structure," *Appl. Phys. Lett.*, vol. 62, No. 16, Apr. 19, 1993, pp. 1878–1880.

Geis et al "Capacitance–Voltage Measurements on Metal–$SiO_2$–Diamond Structures Fabricated with (100)–0 and (111)–Oriented Substrates," *IEEE Transactions on Electron Devices*, vol. 38, No. 3, Mar. 1991, pp. 619–626.

Robertson "Deposition of diamond–like carbon," *Phil. Trans. R. Soc. Land. A*, vol. 342, 1993, pp. 277–286.

Geis et al "Diamond Field–Emission Cathodes," *Conference Record—1994 Tri–Service/NASA Cathode Workshop*, Cleveland, Ohio, Mar. 29–31, 1994.

Twichell "Diamond Field–Emission Cathode Technology," Lincoln Laboratory @ MIT.

Nistor et al "Direct Observation of Laser–Induced Crystallization of a–C:H Films," *Appl. Phys. A*, vol. 58, 1994, pp. 137–144.

"Electrical characterization of gridded field emission arrays," *Inst. Phys. Conf. Ser. No. 99: Section 4* Presented at *2nd Int. Conf. on Vac. Microelectron.*, Bath, 1989, pp. 81–84.

"Electrical phenomena occuring at the surface of electrically stressed metal cathodes. I. Electroluminescence and breakdown phenomena with medium gap spacings (2–8 mm)," *J. Phys. D: Appl. Phys.*, vol. 12, 1979, pp. 2229–2245.

Okano et al "Electron emission from phosphorus– and boron–doped polycrystalline diamond films," *Electronics Letters*, vol. 31, No. 1, Jan. 1995, pp. 74–75.

Xu et al. "Field–dependence of the Area–Density of 'Cold' Electron Emission Sites on Broad–Area CVD Diamond Films," *Electronics Letters*, vol. 29, No. 18, Sep. 2, 1993, pp. 1596–1597.

Pimenov et al. "Laser–Assisted Selective Area Metallization of Diamond Surface by Electroless Nickel Plating," *2nd International Conference on the Applications of Diamond Films and Related Materials*, 1993, p. 303–306.

Huang et al. "Monte Carlo Simulation of Ballistic Charge Transport in Diamond under an Internal Electric Field," Dept. of Physics, The Penn. State Univ., University Park, PA, Mar. 3, 1995.

Tasaka et al "Optical obvervation of plumes formed at laser ablation of carbon materials," *Applied Surface Science*, vol. 79/80, 1994, pp. 141–145.

Yu et al "Optical Recording in Diamond–Like Carbon Films," *JJAP Series 6, Proc. Int. Symp. on Optical Memory*, 1991, pp. 116–120.

Wang et al. "Real–time, in situ photoelectron emission microscopy observation of CVD diamond oxidation and dissolution on molybdenum," *Diamond and Related Materials*, vol. 3, 1994, 1994, pp. 1066–1071.

Spindt et al "Recent Progress in Low–Voltage Field–Emission Cathode Development," *Journal de Physique*, Colloque C9, supp. au no. 12, Tome 45, Dec. 12984, pp. C9–269–278.

Py et al "Stability of the emission of a microtip," *J. Vac. Sci. Technol. B*, vol. 12, No. 2, Mar./Apr. 1994, pp. 685–688.

Avakyan et al. "Angular Characteristics of the Radiation by Ultra Relativistic Electrons in Thick Diamond Single Crystals," *Sov. Tech. Phys. Lett.*, vol. 11, No. 11, Nov. 1985, pp. 574–575.

Bajic et al. "Enhanced cold–cathode emission using composite resin–carbon coatings," Dept. of Electronic Eng. & Applied Physics, Aston Univ., Aston Triangle, Birmingham, UK, May 29, 1987.

Bajic et al. "Enhanced Cold–Cathode Emission Using Composite Resin–Carbon Coatings," Dept. of Electronic Eng. & Applied Phiscs, Aston Univ., Aston Triangle, Birmingham, UK, May 29, 1987.

Banks "Topography: Texturing Effects," *Handbook of Ion Beam Processing Technology*, Chapter 17, pp. 338–361.

C. Xie "Field Emission Characteristic Requirements for Field Emission Displays," *Conf. of 1994 Int. Display Research Conf. and Int. Workshops on Active–Matrix LCDs & Display Mat'ls*, Oct. 1994.

Chen "Optical Emission Diagnostics of Laser–Induced Plasma for Diamond–like Film Deposition," *Applied Physics A—Solids and Surfaces*, vol. 52, 1991, pp. 328–334.

Chen and Mazumder "Emission spectroscopy during excimer laser ablation of graphite," *Appl. Phys. Letters*, vol. 57, No. 21, Nov. 19, 1990, pp. 2178–2180.

Chenggang Xie, et al. "Electron Field Emission from Amorphic Diamond Thin Films," *6th International Vacuum Microelectronics Conference Technical Digest*, 1993, pp. 162–163.

ChenggangXie et al. "Use of Diamond Thin Films for Low Cost field Emissions Displays," *7th International Vacuum Microelectronics Conference Technical Digest*, 1994, pp. 229–232.

Collins et al "Laser plasma source of amorphic diamond," *Appl. Phys. Lett.*, vol. 54, No. 3, Jan. 16, 1989, pp. 216–218.

Collins et al. "The bonding of protective films of amorphic diamond to titanium," *J. Appl. Phys.*, vol. 71, No. 7, Apr. 1, 1992, pp. 3260–3265.

Collins et al. "Microstructure of Amorphic Diamond Films," The Univ. of Texas at Dallas, Center for Quantum Electronics, Richardson, Texas.

Collins et al. "Thin–Film Diamond," *The Texas Journal of Science*, vol. 41, No. 4, 1989, pp. 343–358.

Data Sheet on Display Driver, HV38, Supertex, Inc., pp. 11–43 to 11–50.

Data Sheet on Voltage Drive, HV 622, Supertex Inc., pp. 1–5, Sep. 22, 1992.

Data Sheet on Voltage Driver, HV620, Supertex Inc., pp. 1–6, May 21, 1993.

Data Sheet on Anode Drive SN755769, Texas Instruments, pp. 4–81 to 4–88.

Davanloo et al. "Amorphic diamond films produced by a laser plasma source," *J. Appl. Physics*, vol. 67, No. 4, Feb. 15, 1990, pp. 2081–2087.

Djuba et al. "Emission Properties of Spindt–Type Cold Cathodes with Different Emission Cone Material", *IEEE Transactions on Electron Devices*, vol. 38, No. 10, Oct. 1991.

Fink et al. "Optimization of Amorphic Diamond™ for Diode Field Emission Displays," Microelectronics and Computer Technology Corporation and SI Diamond Technology, Inc.

Geis et al. "Diamond Cold Cathode," *IEEE Electron Device Letters*, vol. 12, No. 8, Aug. 1991, pp. 456–459.

Ghis et al. "Sealed Vacuum Devices: Microchips Fluorescent Display," *3rd International Vacuum Microelectronics Conference*, Monterrey, U.S.A., Jul. 1990 [copy to be provided].

Gorbunov "Spatial characteristics of laser pulsed plasma deposition of thin films," *SPIE*, vol. 1352, *Laser Surface Microprocessing*, 1989, pp. 95–99.

Hastie, et al. "Thermochemistry of materials by laser vaporization mass spectrometry: 2. Graphite," *High Temperatures—High Pressures*, vol. 20, 1988, pp. 73–89.

Hastie et al. "High Temperature Chemistry in Laser Plumes," *John L. Margrave Research Symposium*, Rice University, Apr. 29, 1994.

Kumar et al "Diamond–based field emission flat panel displays," *Solid State Technology*, May 1995, pp. 71–74.

Kurnar et al. "Field Emission Displays Based on Diamond Thin Films," *Society of Information Display Conference Technical Digest*, 1993, pp. 1009–1010.

Kurnar et al. "Development of Nano–Crystaline Diamond–Based Field–Emission Displays," Society of Information Display *SID 94Digest*, 1994, pp. 43–45.

Marquardt et al. "Deposition of Amorphous Carbon Films from Laser–Produced Plasmas," *Mat. Res. Soc. Sump. Proc.*, vol. 38, 1985, pp. 326–335.

Muller, et al. "A Comparative Study of Deposition of Thin Films by Laser Induced PVD with Femtosecond and Nanosecond Laser Pulses," *SPIE*, vol. 1858, 1993, pp. 464–475.

N. Puperter et al. "Field Emission Measurements with$\mu$m Resolution on CVD–Polycrystalline Diamond Films," To be published and presented at the *8th IVMC '95*, Portland, Oregon.

Noer "Electron Field Emission from Broad–Area Electrodes," *Applied Physics A—Solids and Surfaces*, vol. 28, 1982, pp. 1–24.

Pappas, et al "Characterization of laser vaporization plasmas generated for the deposition of diamond–like carbon," *J. Appl. Phys.*, vol. 72, No. 9, Nov. 1, 1992, pp. 3966–3970.

Schenck, et al. "Optical characterization of thin film laser deposition processes," *SPIE*, vol. 1594, *Process Module Metrology, Control, and Clustering*, 1991, pp. 411–417.

Shovlin et al. "Synchrotron radiation photoelectron emission microscopy of chemical–vapor–deposited diamond electron emitters," *J. Vac. Sci. Technol. A*, vol. 13, No. 3, May/Jun. 1995, pp. 1–5.
Spindt et al. "Physical properties of thin film field emission cathodes with molybdenum cones," *Journal of Applied Physics*, vol. 47, No. 12, 1976, pp. 5248–5263.
Tzeng et al. "Diamond Cold Cathodes: Applications of Diamond Films and Related Materials," Elsevier Science Publishers BN, 1991, pp. 309–310 [copy to be provided].
van der Weide et al. "Schottky barrier height and negative electron affinity of titanium on (111) diamond," *J. Vac. Sci. Technol. B*, vol. 10, No. 4, Jul./Aug. 1992, pp. 1940–1943.
Wagal, et al. "Diamond–like carbon films prepared with a laser ion source," *Appl. Phys. Lett.*, vol. 53, No. 3, Jul. 18, 1988, pp. 187–188.
Wang, et al. "Cold Field Emission From CVD Diamond Films Observed in Emission Electron Microscopy,"–*Electronics Letters*, vol. 27, pp 1459–1461, Jun. 10, 1991.
Warren "Control of silicon field emitter shape with isotrophically etched oxide masks," *Inst. Phys. Conf. Ser. No. 99: Section 2*, Presented at *2nd Int. Conf. on Vac. Microelectron.*, Bath, 1989, pp. 37–40.
Wehner "Cone formation as a result of whisker growth on ion bombarded metal surfaces," *J. Vac. Sci. Technol. A*, vol. 3, No. 4, Jul./Aug. 1985, pp. 1821–1834.
Wehner et al. "Cone Formation on Metal Targets During Sputtering," *J. Appl. Physics*, vol. 42, No. 3, Mar. 1, 1971, p. 1145–1149.
Xu et al "Characterisation of the Field Emitting Properties of CVD Diamond Films," *Conference Record—1994 Tri–Service/NASA Cathode Workshop*, Cleveland, Ohio, Mar. 29–31, 1994, pp. 91–94.
"Method of Making Field Emission Tips Using Physical Vapor Deposition of Random Nuclei as Etch Mask," Ser. No. 08/232,790 filed Apr. 22, 1994.
"Method of Making Field Emission Tips Using Physical Vapor Deposition of Random Nuclei as Etch Mask," International Application No. PCT/US94/04568 filed Apr. 22, 1994.
"Flat Panel Display Based On Diamond Thin Films," Ser. No. 08/300,771, filed Jun. 20, 1994.
"Amorphic Diamond Film Flat Field Emission Cathode," Ser. No. 08/071,157 filed Jun. 2, 1993.
"Diode Structure Flat Panel,"0 Ser. No. 07/995,846 filed Dec. 23, 1992.
"Triode Structure Flat Panel Display Employing Flat Field Emission Cathodes," Ser. No. 07/993,863 filed Dec. 23, 1992.
"Triode Structure Flat Panel Display Employing Flat Field Emission Cathodes," Ser. No. 08/458,854 filed Jun. 2, 1995.
"Methods for Fabricating Flat Panel Display Systems and Components," Ser. No. 08/147,700 filed Nov. 4, 1993.
"System and Method for Achieving Uniform Screen Brightness Within a Matrix Display," Ser. No. 08/292,135 filed Aug. 17, 1994.
"Method for Producing Thin, Uniform Powder Phosphor for Display Screens," Ser. No. 08/304,918 filed Sep. 13, 1994.
"Method of Making a Field Emission Electron Source with Random Micro–tip Structures," Ser. No. 08/427,464 filed Apr. 24, 1995.
"Flat Panel Display Based on Diamond Thin Films," Ser. No. 08/326,302 filed Nov. 19, 1994.
"System and Method for Depositing a Diamond–like Film on a Substrate," Ser. No. 08/320,626 filed Nov. 7, 1994.
"Electrochemical Doping of Phosphors Via Codeposition with Inorganic Cations," Ser. No. 08/382,319 filed Feb. 1, 1995.
"A Field Emission Display Device," Ser. No. 08/456,453 filed Jun. 1, 1995.
"Pretreatment Process for a Surface Texturing Process," Ser. No. 08/427,462 filed Apr. 24, 1995.
"Field Emitter with Wide Band Gap Emission," Ser. No. 08/264,386 filed Jun. 23, 1994.
"A Method of Making a Field Emitter," Ser. No. 08/457,962 filed Jun. 01, 1995.
"Cone Formation as a Result of Whisker Growth on Ion Bombarded Metal Surfaces," G.K. Wehner, *J. Vac. Sci. Technol.* A 3(4), Jul./Aug. 1985, pp. 1821–1834.
"Cone Formation on Metal Targets During Sputtering," G.K. Wehner and D.J. Hajicek, *J. Appl. Physics*, vol. 42, No. 3, Mar. 1, 1971, pp. 1145–1149.
"Physical Properties of Thin Film Field Emission Cathodes," C.A. Spindt, et al, *J. Appl. Phys.*,, vol. 47, 1976, p. 5248–63.
"Topography: Texturing Effects," Bruce A. Banks, *Handbook of Ion Beam Processing Technology*, No. 17, pp. 338–361.
"A Comparative Study of Deposition of Thin Films by Laser Induced PVD with Femtosecond and Nanosecond Laser Pulses," Muller, et al, *SPIE*, vol. 1858 (1993), pp. 464–475.
"Amorphic Diamond Films Produced by a Laser Plasma Source," Davanloo et al., *Journal Appl. Physics*, vol. 67, No. 4, Feb. 15, 1990, pp. 2081–2087.
"Characterization of Laser Vaporization Plasmas Generated for the Deposition of Diamond–Like Carbon," Pappas, et al., *J. Appl. Phys.*, vol. 72, No. 9, Nov. 1, 1992, pp. 3966–3970.
"Deposition of Amorphous Carbon Films from Laser–Produced Plasmas," Marquardt, et al, *Mat. Res. Soc. Sump. Proc.*, vol. 38, (1985), pp. 326–335.
"Development of Nano–Crystaline Diamond–Based Field–Emission Displays," Kurnar et al., *Society of Information Display Conference Technical Digest*, 1994, pp. 43–45.
"Diamond–like Carbon Films Prepared with a Laser Ion Source," Wagal, et al., *Appl. Phys. Lett.*, vol. 53, No. 3, Jul. 18, 1988, pp. 187–188.
"Diamond Cold Cathode," Geis et al., *IEEE Electron Device Letters*, vol. 12, No. 8, (Aug. 1989)? pp. 456–459.
"Emission Spectroscopy During Excimer Laser Albation of Graphite," Chen and Mazumder, *Appl. Phys. Letters*, vol. 57, No. 21, Nov. 19, 1990, pp. 2178–2180.
"Enhanced Cold–Cathode Emission Using Composite Resin–Carbon Coatings," S. Bajic and R.V. Latham, Dept. of Electronic Eng. & Applied Physics, Aston Univ., Aston Triangle, Birmingham B4 7ET, UK, May 29, 1987.
"High Temperature Chemistry in Laser Plumes," Hastie et al., John L. Margrave Research Symposium, Rice University, Apr. 29, 1994.
"Laser Plasma Source of Amorphic Diamond," Collins et al., *Appl. Phys. Lett.*, vol. 54, No. 3, Jan. 16, 1989, pp. 216–218.
"Optical Characterization of Thin Film Laser Deposition Processes," Schenck, et al., *SPIE*, vol. 1594, *Process Module Metrology, Control, and Clustering* (1991), pp. 411–417.
"Optical Emission Diagnostics of Laser–Induced Plasma for Diamond–Like Film Deposition," Chen, *Appl. Phys.*, vol. 52A, 1991, pp. 328–334.

"Optical Observation of Plumes Formed at Laser Ablation of Carbon Materials," Tasaka et al., *Appl. Surface Science*, vol. 79/80, 1994, pp. 141–145.
"Spatial Characteristics of Laser Pulsed Plasma Deposition of Thin Films," Gorbunov, *SPIE*, vol. 1352, *Laser Surface Microprocessing* (1989), pp. 95–99.
"The Bonding of Protective Films of Amorphic Diamond to Titanium," Collins, et al., *J. Appl. Phys.*, vol. 71, No. 7, Apr. 1, 1992, pp. 3260–3265.
"Thermochemistry of Materials by Laser Vaporization Mass Spectrometry: 2. Graphite," Hastie et al., *High Temperatures–High Pressures*, vol. 20, 1988, pp. 73–89.
"Electron Field Emission from Broad–Area Electrodes," Noer, *Applied Physics* A 28, 1982, pp. 1–24.
"Emission Properties of Spindt–Type Cold Cathodes with Different Emission Cone Material", Djubua et al., *IEEE Transactions on Electron Devices*, vol. 38, No. 10, Oct. 1991.
"Enhanced Cold–Cathode Emission Using Composite Resin–Carbon Coatings," S. Bajic and R.V. Latham, Dept. of Electronic Eng. & Applied Phiscs, Aston Univ., Aston Triangle, Birmingham B4 7ET, UK, May 29, 1987.
"Field Emission Displays Based on Diamond Thin Films," Kurnar et al., *Society of Information Display Conference Technical Digest*, 1993, pp. 1009–1010.

"Recent Development on 'Microtips' Display at LETI," Meyer et al., *Technical Digest of IUMC 91*, Nagahama 1991, pp. 6–9.

Data Sheet on Anode Drive SN755769, Texas Instruments, pp. 4–81 to 4–88.

Data Sheet on Display Driver, HV38, Supertex, Inc., pp. 11–43 to 11–50.

Data Sheet on Voltage Driver, HV620, Supertex Inc., pp. 1–6, May 21, 1993.

Data Sheet on Voltage Drive, HV 622, Supertex Inc., pp. 1–5, Sep. 22, 1992.

* cited by examiner

FIG. 6
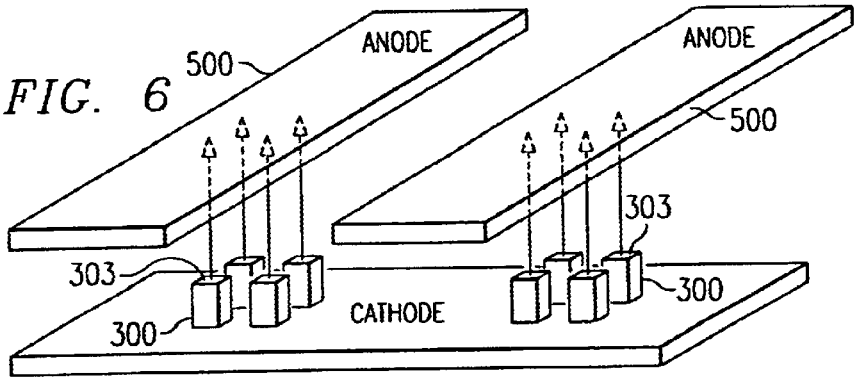
FIG. 7a
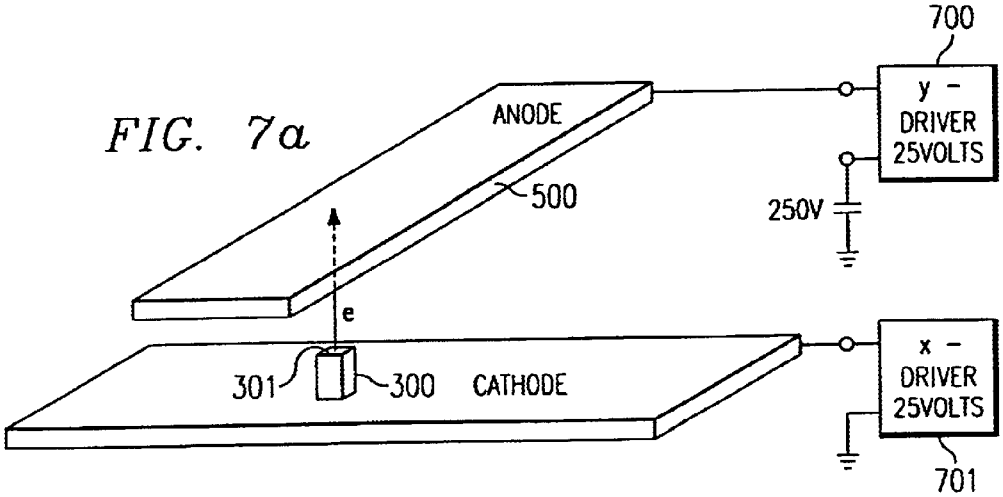
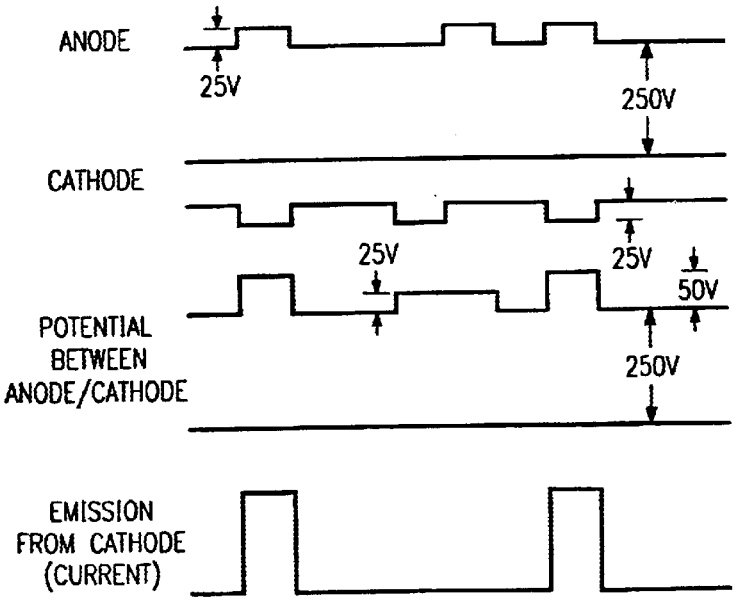
FIG. 7c

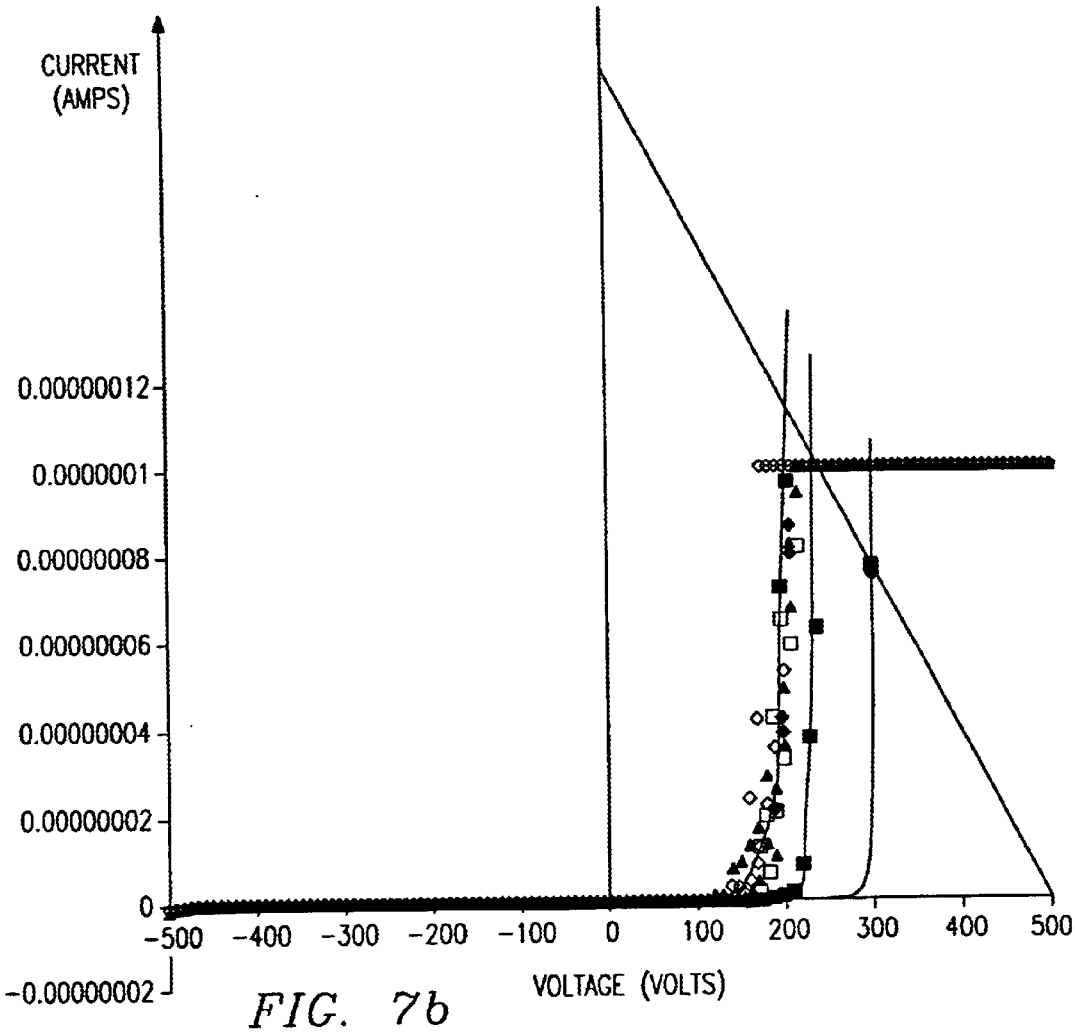
FIG. 7b
FIG. 8
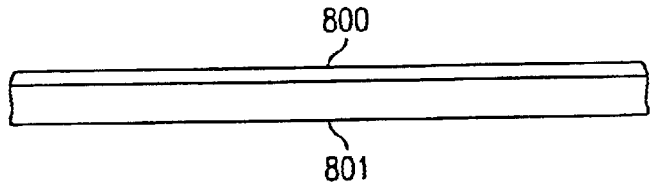
FIG. 9
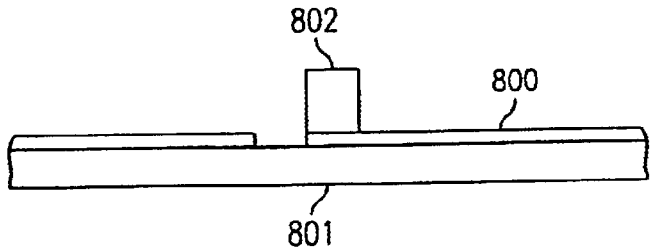

METHOD OF MAKING FLAT PANEL DISPLAYS HAVING DIAMOND THIN FILM CATHODE

This is a continuation of application Ser. No. 08/326,302 filed Oct. 19, 1994, which issued as U.S. Pat. No. 5,551,903, which is a divisional of application Ser. No. 08/300,771 filed Jun. 20, 1994, which is a continuation of Ser. No. 07/851,701 filed Mar. 16, 1992, abandoned.

TECHNICAL FIELD OF THE INVENTION

This invention relates in general to flat panel displays for computers and the like and, more specifically, to such displays incorporating diamond film to improve image intensity at low cost.

BACKGROUND OF THE INVENTION

Field emitters are useful in various applications such as flat panel displays and vacuum microelectronics. Field emission based flat panel displays have several advantages over other types of flat panel displays, which include low power consumption, high intensity and low projected cost. Current field emitters using micro-fabricated metal tips suffer from complex fabrication process and very low yield, thereby increasing the display cost. Thus, an improved field emitter material and device structure, and a less complex fabrication process is clearly desired. This invention addresses all of these issues.

The present invention can be better appreciated with an understanding of the related physics. In general, the energy of electrons on surface of a metal or semiconductor is lower than electrons at rest in vacuum. In order to emit the electrons from any material to vacuum, energy must be supplied to the electrons inside the material. That is, the metal fails to emit electrons unless the electrons are provided with energy greater than or equal to the electrons at rest in the vacuum. Energy can be provided by numerous means, such as by heat or irradiation with light. When sufficient energy is imparted to the metal, emission occurs and the metal emits electrons. Several types of electron emission phenomena are known. Thermionic emission involves an electrically charged particle emitted by an incandescent substance (as in a vacuum tube or incandescent light bulb). Photoemission releases electrons from a material by means of energy supplied by incidence of radiation, especially light. Secondary emission occurs by bombardment of a substance with charged particles such as electrons or ions. Electron injection involves the emission from one solid to another. Finally, field emission refers to the emission of electrons due to an electric field.

In field emission, electrons under the influence of a strong electric field are injected out of a substance (usually a metal or semiconductor) into a dielectric (usually vacuum). The electrons "tunnel" through a potential barrier instead of escaping "over" it as in thermionic of photo-emission. Field emission was first correctly treated as a quantum mechanical tunneling phenomenon by Fowler and Nordheim (FN). The total emission current j is given by $$j = \frac{(1.54\times10^{-6}V^2\beta^2}{\phi t^2(y)}\exp\left(\frac{-(6.83\times10^9)\phi^{3/2}v(y)\beta d}{V}\right) \quad (1)$$

as calculated from the Schrodinger equation using the WKB approximation. For electrical fields typically applied, v(y) varies between 0.9 and 1.0, and t is very close to 1.0. Hence, as a rough approximation these functions may be ignored in equation (1), in which case it is evident that a "FN plot" of $\ln(j/V^2)$ vs 1/V should result in a straight line with slope—$(6.83\times10^9)\phi^{3/2}\beta d$ and intercept $(1.54\times10^{-6})\beta^2/\phi$. A more detailed discussion of the physics of field emission can be found in R. J. Noer "Electron Field Emission from Broad Area Electrodes", Appli. Phys., A-28, 1–24 (1982); Cade and Lee, "Vacuum Microelectronics", GEC J. Res. Inc., Marconi Rev., 7(3), 129 (1990); and Cutler and Tsong, Field Emission and Related Topics (1978).

For a typical metal with a phi of 4.5 eV, an electric field on the order of $10^9$V/m is needed to get measurable emission currents. The high electric fields needed for field emission require geometric enhancement of the field at a sharp emission tip, in order that unambiguous field emission can be observed, rather than some dielectric breakdown in the electrode support dielectric materials. The shape of a field emitter effects its emission characteristics. Field emission is most easily obtained from sharply pointed needles or tips. The typical structure of a lithographically defined sharp tip for a cold cathode is made up of small emitter structures 1–2 $\mu$m in height, with submicron (<50 nm) emitting tips. These are separated from a 0.5 $\mu$m thick metal grid by a layer of silicon dioxide. Results from Stanford Research Institute ("SRI") have shown that 100 $\mu$A/tip at a cathode-grid bias of 100–200 V. An overview of vacuum electronics and Spindt type cathodes is found in the November and December, 1989, issues of IEEE Transactions of Electronic Devices. Fabrication of such fine tips, however, normally requires extensive fabrication facilities to finely tailor the emitter into a conical shape. Further, it is difficult to build large area field emitters since the cone size is limited by the lithographic equipment. It is also difficult to perform fine feature lithography on large area substrates as required by flat panel display type applications.

The electron affinity (also called work function) of the electron emitting surface or tip of a field emitter also affects emission characteristics. Electron affinity is the voltage (or energy) required to extract or emit electrons from a surface. The lower the electron affinity, the lower the voltage required to produce a particular amount of emission. If the electron affinity is negative then the surface shall spontaneously emit electrons until stopped by space charge, although the space charge can be overcome by applying a small voltage, e.g. 5 volts. Compared to the 1,000 to 2,000 volts normally required to achieve field emission from tungsten, a widely used field emitter, such small voltages are highly advantageous. There are several materials which exhibit negative electron affinity, but almost all of these materials are alkali metal-based. Alkali metals are very sensitive to atmospheric conditions and tend to decompose when exposed to air or moisture. Additionally, alkali metals have low melting points, typically below 1000° C., which is unsuitable in most applications.

For a full understanding of the prior art related to the present invention, certain attributes of diamond must also be discussed. Recently, it has been experimentally confirmed that the (111) surface of diamond crystal has an electron affinity of −0.7+/−0.5 electron volts, showing it to possess negative electron affinity. Diamond cold cathodes have been reported by Geis et al. in "Diamond Cold Cathode", IEEE Electron Device Letters, Vol 12, No. 8, August 1991, pp. 456–459; and in "Diamond Cold Cathodes", Applications of Diamond Films and Related Materials, Tzeng et al. (Editors), Elsevier Science Publishers B.V., 1991, pp. 309–310. The diamond cold cathodes are formed by fabricating mesa-etched diodes using carbon ion implantation into p-type diamond substrates. Recently, Kordesch et al ("Cold field emission from CVD diamond films observed in emission electron microscopy", 1991) reported that thick (100 $\mu$m) chemical vapor deposited polycrystalline diamond films fabricated at high temperatures have been observed to emit electrons with an intensity sufficient to form an image in the accelerating field of an emission microscope without external excitation (<3 MV/m). It is obvious that diamond thin film will be a low electric field cathode material for various applications.

SUMMARY OF THE INVENTION

In accordance with the present invention, a flat panel display is provided which incorporates diamond film to improve image intensity at low cost.

The present invention specifically provides for a flat panel display with a diamond field emission cathode to achieve the advantages noted above.

BRIEF DESCRIPTION OF THE DRAWINGS

For a more complete understanding of the present invention, and the advantages thereof, reference is now made to the following descriptions taken in conjunction with the accompanying drawings, in which:

FIG. 6 shows a diamond film emission cathode having multiple field emitters for each pixel;

FIG. 7*a* shows a diode biasing circuit;

FIG. 7*b* shows a typical I-V curve for a diode and an operational load-line using an internal pillar resistor of 2.5 Ohms;

FIG. 7*c* shows a timing diagram of the operation of the anode and cathode;

FIG. 8 shows the step of depositing a blanket layer of metal on a silicon substrate and a photoresist layer on the metal layer;

FIG. 9 shows the step of removing any remaining photoresist after etching;

DETAILED DESCRIPTION OF THE INVENTION

Vacuum diodes are fabricated across the expanse of a substrate employing standard fabrication techniques including deposition, masking and etching.

Figure 1:
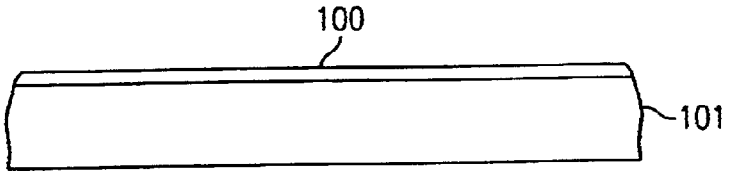
FIG. 1 shows the step of depositing a blanket layer of metal on a glass substrate and a photoresist layer on the metal layer.
Figure 2:
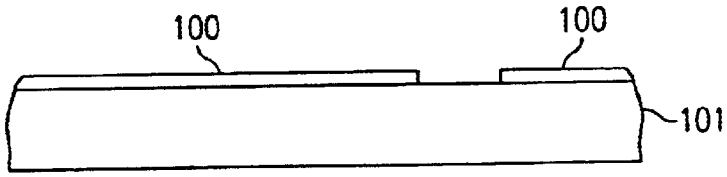
FIG. 2 shows the step of removing any remaining photoresist after etching.

Referring to FIG. 1 of the drawings, which shows a beginning step, a blanket layer 100 of 5000 Å thick chromium (which can be another metal such as molybdenum (Mo), aluminum (Al), titanium (Ti) or a combination of these) is deposited by conventional deposition technologies such as evaporation, sputtering deposition on the surface of the glass 101 (or other materials such as silicon wafer or alumina). Then a layer of photo resist is applied by spinning on to a thickness of 1 $\mu$m to 2 $\mu$m and the chromium layer 100 is delineated by mask exposure of the resist layer. The remaining resist layer 100 is a mask to etching of the chromium layer 100. The function of the chromium layer 100 is to form the addressing lines and the base for field emitters. The dimensions of the addressing line and the base are determined by different applications. For display applications, the pillar size is about 100 $\mu$m to 250 $\mu$m and the line is about 25 $\mu$m. For vacuum microelectronic devices such as high power, high frequency amplifiers, the feature size is reduced to several microns or even smaller. Finally, any remaining resist after etching is removed (see FIG. 2).

Figure 3:
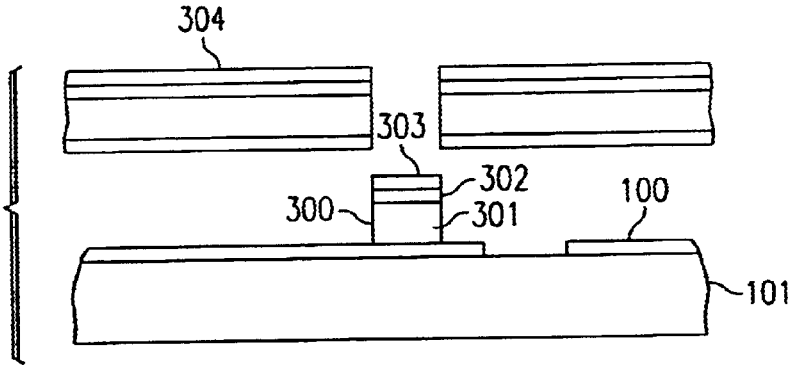
FIG. 3 shows the step of depositing conductive pillars on the layer of metal.

FIG. 3 is the cross sectional view of the next step for fabricating the display. Metal mask deposition technology is used to deposit conductive pillars 300 on top of the bases. The size of the pillars 300 is a little smaller than that of the bases. For example, if the base is 120 $\mu$m wide, the optimized size of the pillars is 100 $\mu$m wide. This requirement reduces the need for aligning the metal mask 304 to the substrate, resulting in a reduction of manufacturing cost. The height of the pillars 300 is determined by device parameters such as operating voltage, spacer size, gap between cathode and anode, and manufacturing cost. 10 $\mu$m high pillars are used here. According to the FN theory of field emission, the emission current is very sensitive to the gap between the cathode and anode and to surface conditions of the cathode. Although using the conventional thin film deposition technologies such as sputtering, evaporation and CVD, the thickness of the thin film cathode can be well controlled within 1%–5% over a large area, the uniformity of the emission current over the large area is still problematic. Assuming 4.5 eV work function of the material and 100 MV/m applied electric field used, a 1% difference in the gap between cathode and anode will cause 10% variations in the emission current. To increase the uniformity of the emission, resistive material is used to build pillars 300. The function of a resistive material is to adjust the potential across the gap between cathode and anode. The higher the pillar, the larger the resistance the pillar has and the smaller the potential across the gap. So the effect of the difference in the pillar height on the emission current is reduced or eliminated if a suitable resistor material is chosen for the pillars 300. Another function of the resistive pillars 300 is to act as a current control layer. Due to reasons such as surface conditions including contamination, roughness, and flatness, the emission current from some emitters is much higher than that of others. Due to the existence of the resistive pillar 300, the potential drop across the pillars which have higher emission current is larger than that of the pillars having smaller emission current. The optimized thickness of the resistive layer 101 in the 10$\mu$m high pillars 300 is 5 $\mu$m.

Referring still to FIG. 3, a 5 $\mu$m thick layer 302 of a high thermal conductive material (such as copper) is deposited on the top of the resistive layer 301 through the holes in the metal mask 304 by evaporation. The function of layer 302 is to help the cathode material (here diamond) dissipate the heat generated by the emission current.

Figure 4:
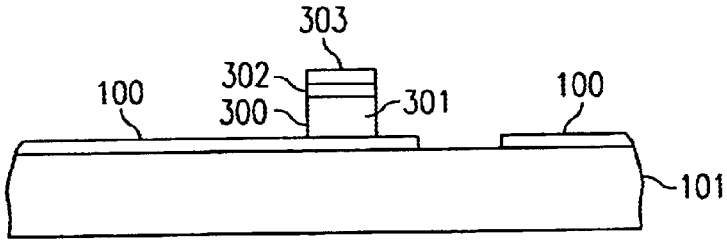
FIG. 4 shows a cross-sectional view of a diamond cathode for display applications.

In FIG. 3, diamond thin film 303 is deposited by room temperature deposition technology such as laser ablation through the holes in the metal mask 304. The thickness of the diamond 303 is about 1 micron or smaller. The low temperature restriction here is only required for a low cost display which uses regular glass as the substrate. FIG. 4 is the completed cross section view of the diamond cathode for display applications. Another way to deposit diamond thin film 303 is to use selective diamond CVD deposition technology. After fabricating the pillar 300, the thin layer of molybdenum (100 Å) is coated on the top surface of the pillar 300 using metal mask deposition technology. Then the diamond thin film 303 is only deposited on the molybdenum surface by selective CVD.

The next step is to fabricate the anode plate 500 (see FIG. 5) with an Indium Tin Oxide ("ITO") layer and phosphors by conventional thin film deposition technologies such as sputtering and evaporation or thick film technology such as screen printing. The substrate is glass. A low energy phosphor film such as zinc oxide (ZnO) is deposited and patterned on the glass with ITO coating. The fabrication process is straightforward, and need not be detailed in this disclosure.

Figure 5:
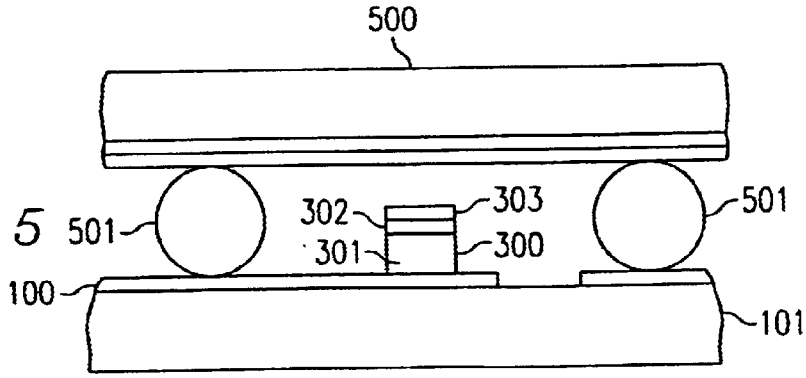
FIG. 5 shows the addition of a spacer following deposition of conductive pillars.

Referring now to FIG. 5, an assembly process of a final device is shown. The cylinder shape spacers 501 of insulator are sandwiched between the anode and cathode layer 100. The thickness of the spacers 501 is 12 $\mu$m so that the gap between cathode and anode is 2 $\mu$m. The requirements for the spacers 501 are 1) very high breakdown strength, a minimum of 100 MV/m at room temperature; 2) very uniform thickness; 3) low cost; and 4) vacuum compatible. Commercially available fibers are used as the spacers 501 for the display. There are several types of insulating fibers available at this time. The most common are optical glass and plastic fibers, and several fibers used in fiber composites. The diameter of the fiber used is around 12 $\mu$m. So the gap in the final device is 2 $\mu$m. The spacers 501 are not limited to a cylindrical shape. Furthermore, laminated layer of mica can be used in place of the fiber. The final step of fabricating the diamond flat panel display is vacuum sealing, which is standard technology. A display with a 2 $\mu$m gap between cathode and anode is designed to operate at 50–60 volts.

The operating voltage for the display described herein is limited by the threshold energy for the phosphor material. The opening voltage must be larger than the threshold energy of the phosphor. For example, regular ZnO film doped with zinc (Zn) has a threshold energy of 300 eV so that the display using this type of phosphor film needs at least 300 Volts operating voltage. The basic parameters for the display are: 20 $\mu$m gap, 10 $\mu$m pillar and 30$\mu$m spacer. The vacuum requirement is moderate, typically $10^{-3}$ torr. FIGS. 29–32 show optical and scanning electron microscope pictures of the actual reduction to practice of FIG. 5.

With reference to FIG. 6, multiple field emitters for each pixel are designed to reduce the failure rate for each pixel, and thereby increase the lifetime of the display and manufacturing yield. Since each emitter for the same pixel has an independent resistive layer, the rest of the emitters for the same pixel will continue to emit electrons if one of the emitters on the pixel fails, whether from a short or open.

Referring to FIG. 7(*a*), a diode biasing circuit 700 and 701 is designed to drive the display with an operating voltage of 300V by using a low voltage semiconductor driver. For full color display, the anode 500 may be patterned in three sets of stripes, each covered with a cathodoluminescent material. However, for simplicity of discussion, only one line on the anode is shown in FIG. 7(*a*). On the cathode plate, the pixels are addressed by an addressing line which is orthogonal to the line on the anode plate 500. The cathode is addressed by a 25 volt driver 701 and the anode 500 is addressed by another 25 volt driver 700 floating on a DC power supply. The output voltage from the DC power supply is chosen to be just below the threshold voltage of the display. For example, for a display with a threshold voltage of 300V, a 250 volt DC power supply is used. By sequential addressing of these electrodes a color image can be displayed. FIG. 7(*b*) shows a typical current-voltage (I-V) curve for a diode and an operational load-line using an internal pillar resistor of 2.5 GΩ. FIG. 7(*c*) depicts the typical application of the anode and cathode voltages and the resulting anode/cathode potential.

There are several ways to fabricate diamond films. Following is a discussion of two different methods. The first method of depositing diamond and diamond-like carbon films is by laser ablation using a Nd:YAG laser bombarding a graphite target. The process has been described in detail elsewhere. FIG. 20 through FIG. 25 show field emission data taken on a sample deposited at room temperature by laser ablation. This data was taken by a tungsten carbide ball held a few microns from the film, varying the voltage applied between the ball and the sample.

Figure 26:
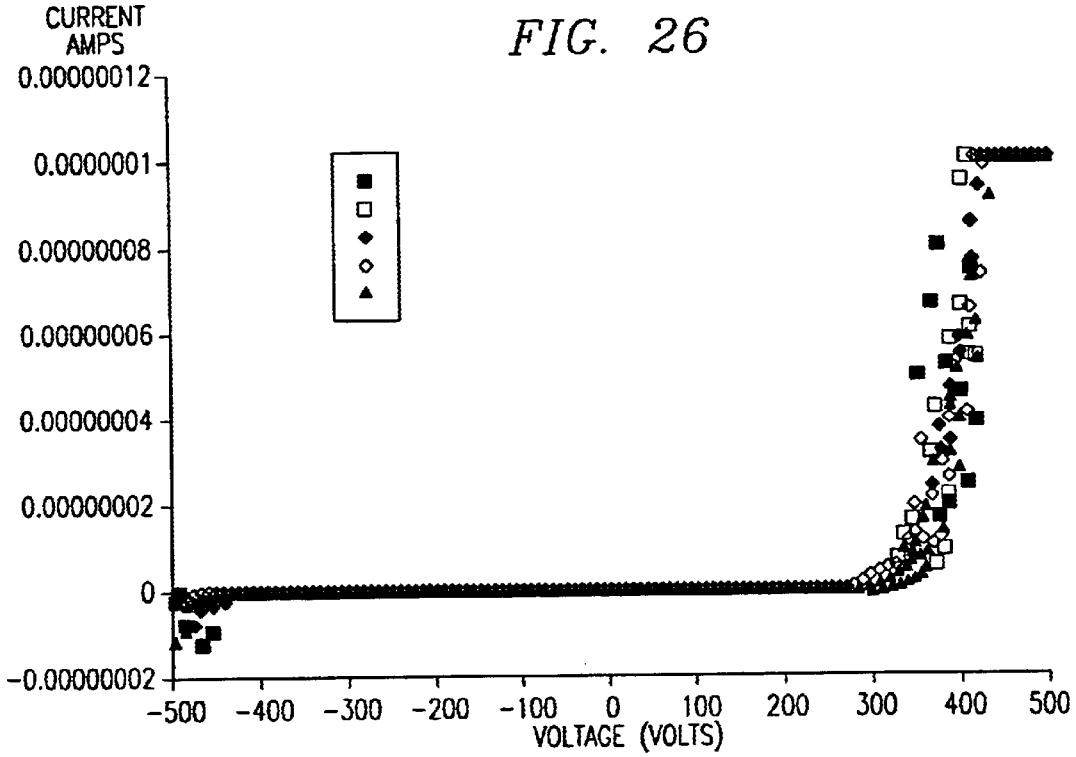
FIGS. 26 through 28 show field emission data taken on a sample formed from methane and hydrogen under conditions of high plasma.
Figure 27:
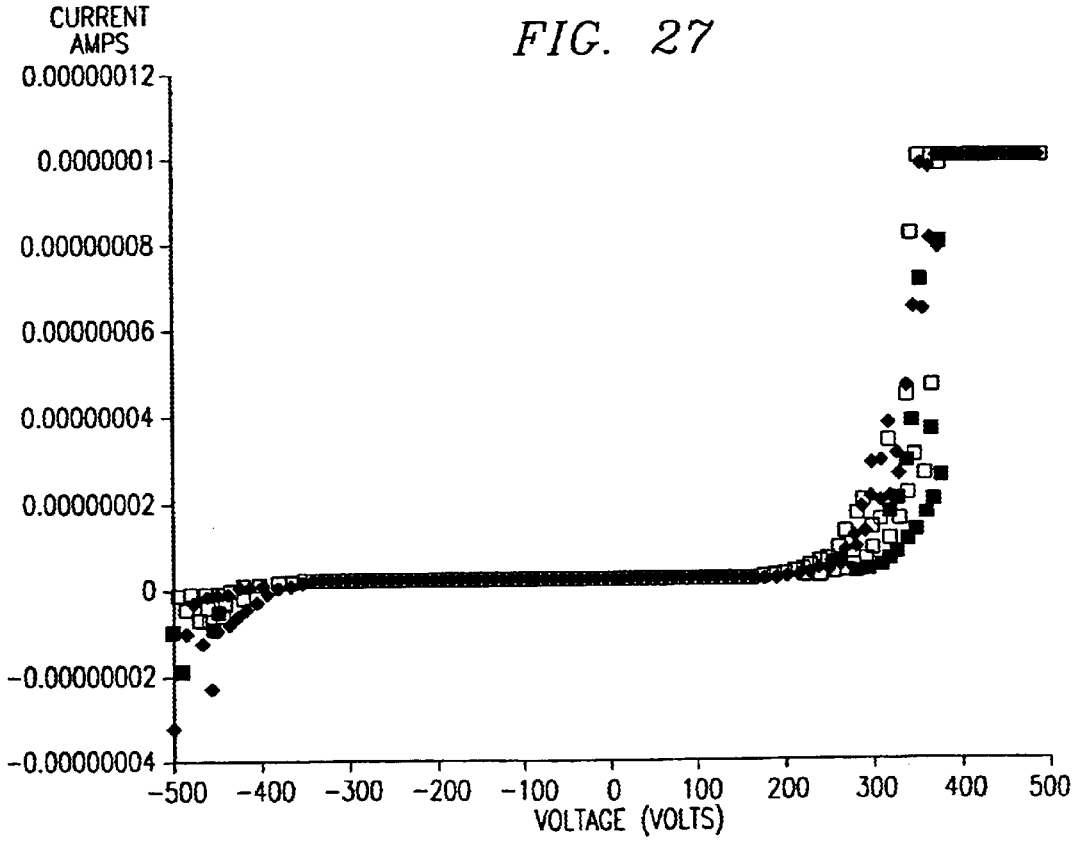
Figure 28:
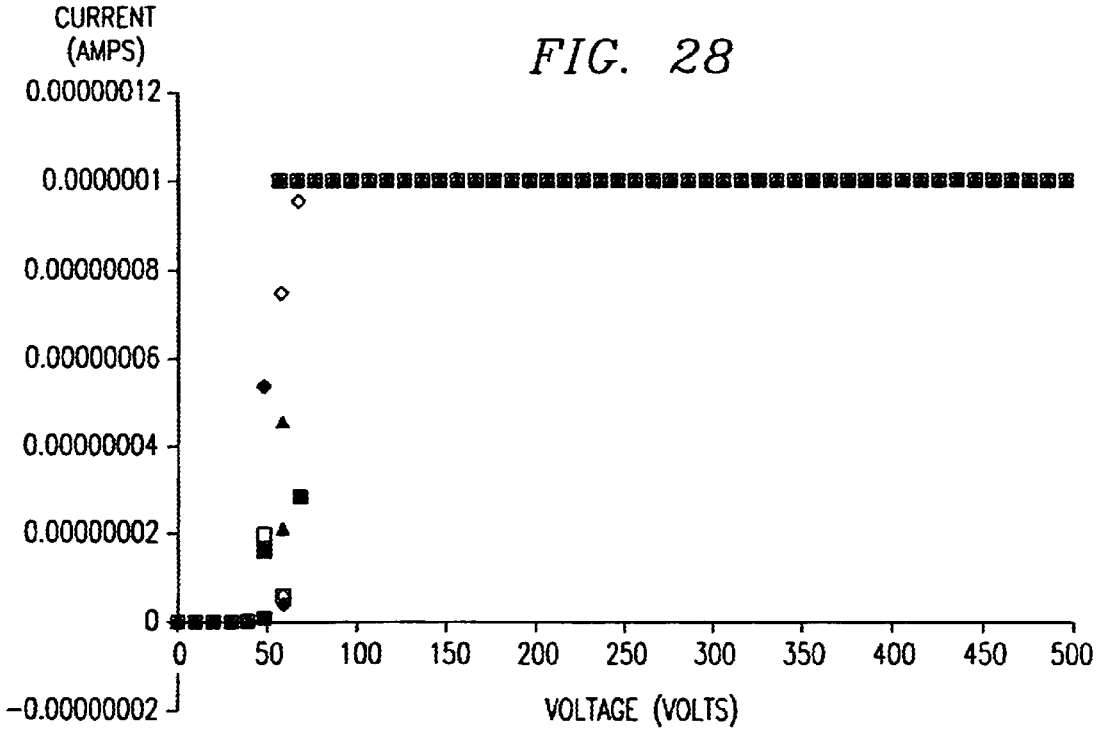
Figure 29A:
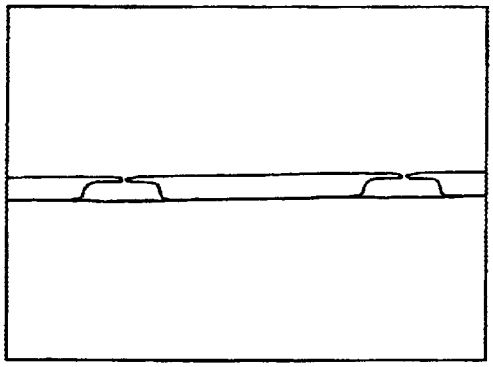
FIGS. 29*a*, 29*b*, 30*a*, 30*b*, 31*a*, 31*b*, 32*a* and 32*b* show optical and scanning electron microscopic pictures of an actual reductio to practice of a device which results after application of the processing step detailed in FIG. 5.
Figure 29B:
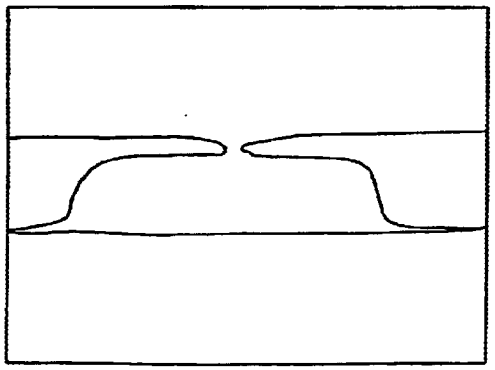
Figure 30A:
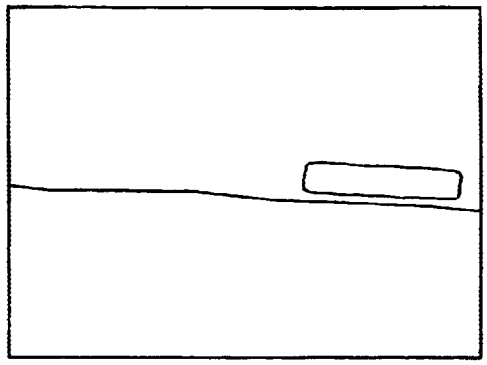
Figure 30B:
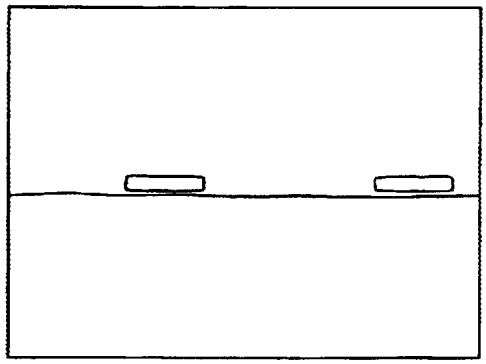
Figure 31A:
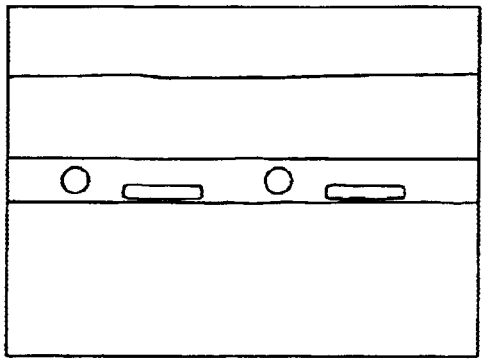
Figure 31B:
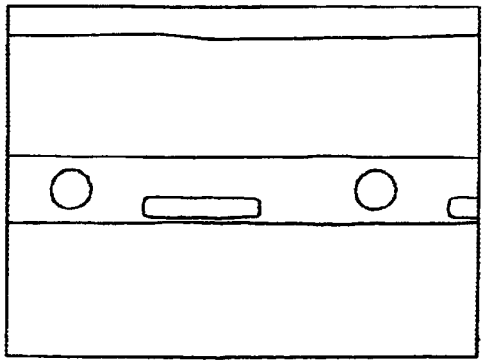
Figure 32A:
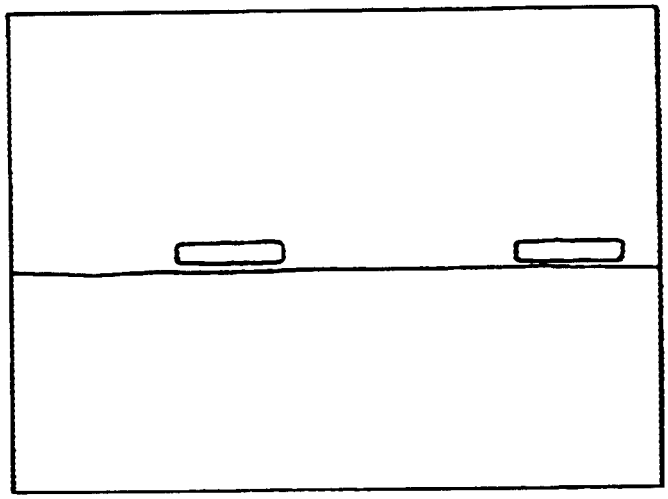
Figure 32B:
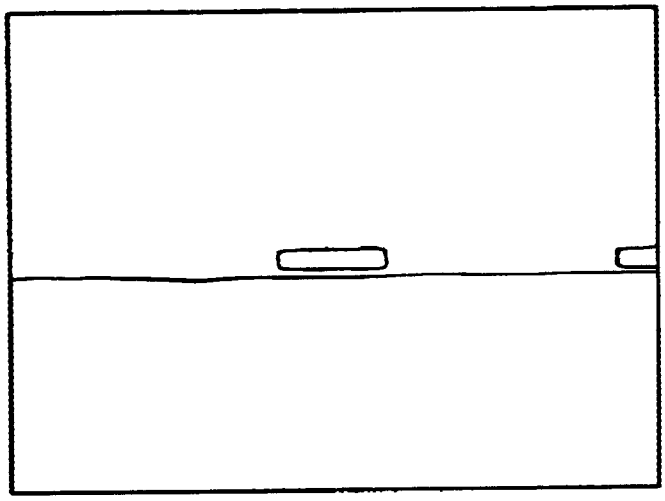

The other method of diamond fabrication is by chemical vapor deposition (CVD). In this case the diamond is formed from methane and hydrogen at very high temperature (400–1000° C.) under conditions of high plasma. The data from such a sample is shown in FIGS. 26 through 28.

FIGS. 16 through 19 show a schematic method to fabricate a three terminal device based on diamond field emitters.

Following are variations on the basic scheme:

1) Resistors under each pixel.
2) Multiple emitters for each pixel. Independent resistors make this very useful.
3) Multiple spacers. There can be two rows of fibers: one aligned with the x-axis, and the other aligned with the y-axis. This will increase the breakdown voltage of the structure.
4) Methods for gray scale FPD. There are two methods for a diode type display. In the first case, the driver changes the voltage applied to the diode in an analog fashion, thereby changing the emission current resulting in various shades of gray. In the second approach, each of the 16 (or a similar number) emitter pillars of each pixel is individually addressed. In this way the current reaching the phosphor can be varied.
5) Even though all the structures shown herein use diamond field emitters, any other low electron affinity material may be used as well. These include various cermet and oxides and borides.
6) Conditioning. All diamond samples need to be conditioned at the beginning of field emission. This involves application of a higher voltage which conditions the emitter surface. After initial conditioning, the threshold voltage for the emitter drops drastically and the emitter operates at that voltage. There may be other methods of conditioning such as thermal activation or photo-conditioning. The displays may require periodic conditioning which may be programmed in such a way that the whole display is conditioned whenever the display is turned on.

There are other applications for diamond cathode field emitters, namely diamond cathodes for a vacuum valve. The structure of micron or submicron vacuum microelectronics with a diamond thin film cathode will be described.

There are many applications of vacuum microelectronics, but they all rely on the distinctive properties of field emitting devices. Vacuum valves do still exist and a great deal of effort has, for many years, been directed towards finding a cold electron source to replace the thermionic cathode in such devices as cathode ray tubes, traveling wave tubes and a range of other microwave power amplifiers. This search has focused particularly on faster start-up, higher current density and lower heater power. Field emission cathodes offer the promise of improvements in all three, resulting in increased operating power and greater efficiency. For example, the high power pulse amplifier used as a beacon on a transmitter for air traffic control has a 6 mm diameter thermionic cathode giving a beam diameter of 3 mm and is capable of a maximum current density of 4 $A/cm^2$. The field emission diode required to obtain an equivalent current would be less than 0.05 mm in diameter. It is clear, however, that if this diode were used in such a traveling wave tube, provisions would have to be made to avoid back bombardment of emitting tips by energetic ions. There has also been growing concern over the ability of solid state electronics to survive in space and over defense systems where they are exposed to both ionizing and electromagnetic radiation. Most semiconductor devices rely on low voltage transport of low density electron gas. When exposed to ionizing radiation, they are bombarded by both neutral and charged particles, which causes both excitation of carriers, changing this density, and trapping of charge at insulator interfaces, leading to significant shifts in bias voltage. The result may be transient upset, or permanent damage if the shifted characteristic leads to runaway currents. The most sensitive insulator involved in a vacuum device is the vacuum itself which will not be permanently damaged by radiation or current overloading.

In addition, the speed of a semiconductor device is ultimately limited by the time taken for an electron to travel from the source to the drain. The transit time is determined by impurity and phono collisions within the lattice of the solid, which lead to electron velocity saturation at about the speed of sound. Vacuum valves, however, operate by electrons passing from cathode to-anode within a vacuum and their passage is therefore unimpaired by molecular collisions. With typical voltages (100V) and dimensions (1 $\mu$m), transit times of less than 1 picosecond can be expected.

Thus, there is a need for a structure of related field emission devices for different applications and a method of making.

Vacuum diodes are fabricated by semiconductor style fabrication technology, allowing micron or submicron dimensional control.

Similar to FIG. 1, FIG. 8 shows a beginning step for submicron or micron vacuum valves. A blank layer 800 of 500 Å thick Al (which can be another metal) is deposited by conventional deposition technologies such as evaporation or sputtering on a silicon wafer 801. In FIG. 9, a layer 802 of photo resist is applied by spinning on to a thickness of 1 $\mu$m to 2 $\mu$m and a chromium layer is delineated by mask exposure to the resist layer. The remaining resist layer is a mask to etching to the Al layer 800. The functions of the Al layer 800 are addressing lines and the base for the field emitter. The dimensions of the addressing line and the base are determined by the different applications. For submicron vacuum values applications, the pillar size is about 1 $\mu$m to 2 $\mu$m or even less and the line is about 0.1 $\mu$m. Finally, the remaining resist on the addressing line is removed by using a second mask and etching process.

Figure 10:
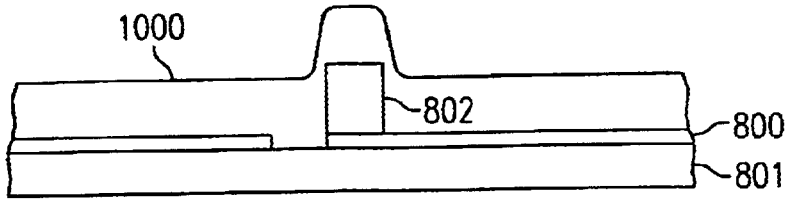
FIG. 10 shows the step of depositing conductive pillars on the layer of metal.
Figure 11:
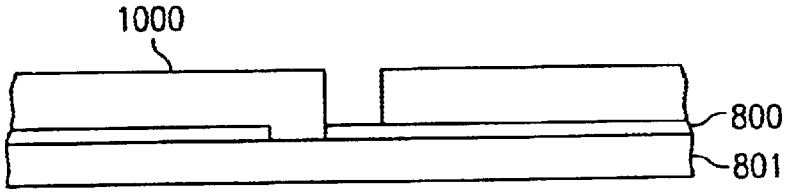
FIG. 11 shows a cross-sectional view of a diamond cathode for display applications.

FIG. 10 is the cross sectional view of the next step for fabricating submicron vacuum valves. An $SiO_2$ layer 1000 of thickness of 1 $\mu$m is deposited by thermal Chemical Vapor Deposition ("CVD") on the substrate. Then in FIG. 11 the remaining resist 802 on the pillar is removed by etching process. FIG. 11 is the cross sectional view of the structure at the second stage.

For the same reasons discussed before, the resistive layer is introduced between the cathode layer (diamond thin film) and the base layer (Al layer). In this disclosure, we use diamond as the cathode material as well as resistive material. The wide energy gap of diamond (5.45 eV) at room temperature is responsible for the high breakdown field of diamond and excellent insulation. It also provides the opportunity to fabricate the diamond thin film with a wide range of resistivity. The closer the doping level to the conductance band or valence band, the lower the resistivity the film has. Attempts to dope diamonds by admixing PH3 were partially successful. Activation energies in the range 0.84–1.15 eV were obtained. Hall effect measurements indicate that phosphorus doped samples have n-type conductivity. Although the resistivity of phosphorous doped films is usually too high for electronic applications, it fits for the resistive layer in the vacuum microelectronics. Sodium (Na) is a potential shallow donor and occupies the tetrahedrally interstitial site. The formation energy for sodium is about 16.6 eV with respect to experimental cohesive energies of bulk Na. As a result the solubility of sodium in diamond is quite low and the doping is performed by ion implantation or some other ion beam technology.

Figure 12:
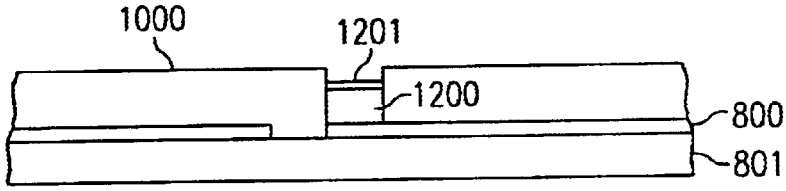
FIG. 12 shows the step of selectively depositing a phosphorus-doped diamond thin film.

Referring to FIG. 12, phosphorus doped diamond thin film 1200 is selectively deposited by plasma CVD technology on the base layer 800. The system used for diamond deposition has an extra gas inlet for doping gas and an ion beam for sodium doping. At first, the ion beam is standby and the gas inlet for PH3 is open. The donor concentration in the diamond is controlled by the flow rate of PH3. The phosphorus concentration in diamond can be varied in the range 0.01–1 wt % depending on the device parameters. The thickness of the phosphorus-doped diamond thin film 1200 is 0.5 $\mu$m. After the thickness of phosphorus-doped diamond thin film 1200 reaches the desired value, the PH3 gas line shuts off and the ion beam for sodium starts to dope the sodium while plasma CBD deposition of diamond thin film 1201 is continuous. The thickness of heavy-doped n-diamond thin film 1201 with a sodium donor is about 100 Å. The difference between the thickness of $SiO_2$ 1000 and the diamond thin film 1201 is about 0.5 $\mu$m.

Figure 13:
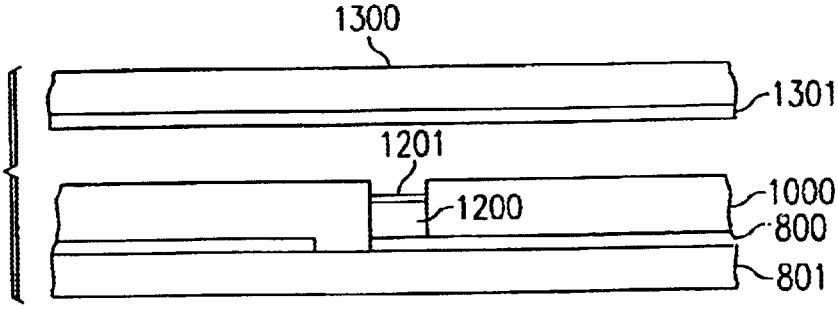
FIG. 13 shows the step of assembling an anode and cathode together.

Referring now to FIG. 13, the silicon wafer 1300 with metallization layer 1301 is fabricated by standard semiconductor technology as an anode plate and both substrates, anode and cathode, are assembled together. The assembly is pumped down to a certain pressure (for example 10–3 torr) and sealed with vacuum compatible adhesive. The pressure inside the devices is determined by the geometry of the devices and the operating voltage. If the operating voltage is lower than the ionization potential which is less than 10 Volts and the gap between the cathode and anode is less than electron mean free path at atmosphere (0.5 $\mu$m), the procedure for vacuum sealing the device can be eliminated. Otherwise, the pressure inside the device should be kept at $10^{-3}$ torr.

Following is a description for diamond coating for a microtip type vacuum triode.

Figure 14:
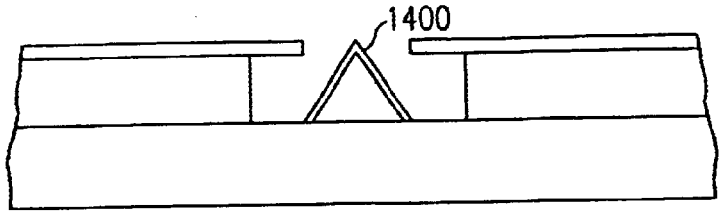
FIG. 14 shows a multielectrode configuration for triode operation.

FIG. 14 shows a multielectrode configuration for triode operation. The detail of the structure and fabrication process have been well known for many years. For purposes of the present invention the well-known process to fabricate the microtips and coat the tips with diamond thin film 1400 of 100 Å thickness by using selective CVD deposition is followed. The diamond coating results in the reduction of the operating voltage from 135 volts to 15 volts since the threshold electric field for diamond is much lower than that for any refractory metal.

Figure 15:
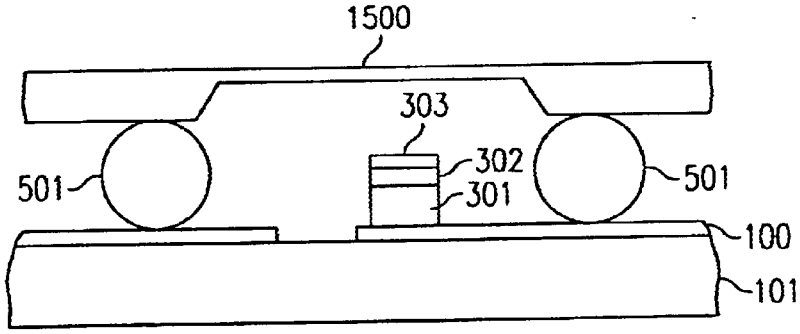
FIG. 15 shows a structure of a sensor having a diamond cathode.
Figure 16:
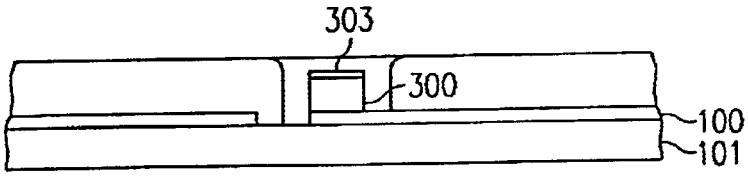
FIGS. 16 through 19 show a schematic method to fabricate a three terminal device based on diamond field emitters.
Figure 17:
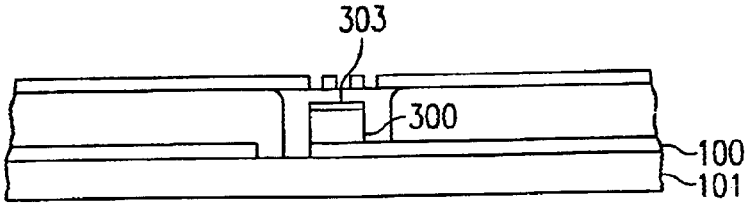
Figure 18:
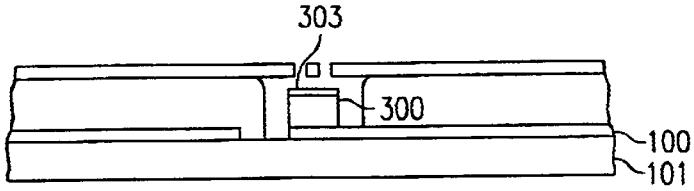
Figure 19:
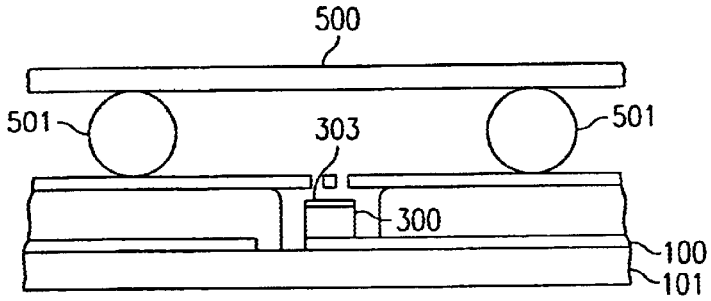
Figure 20:
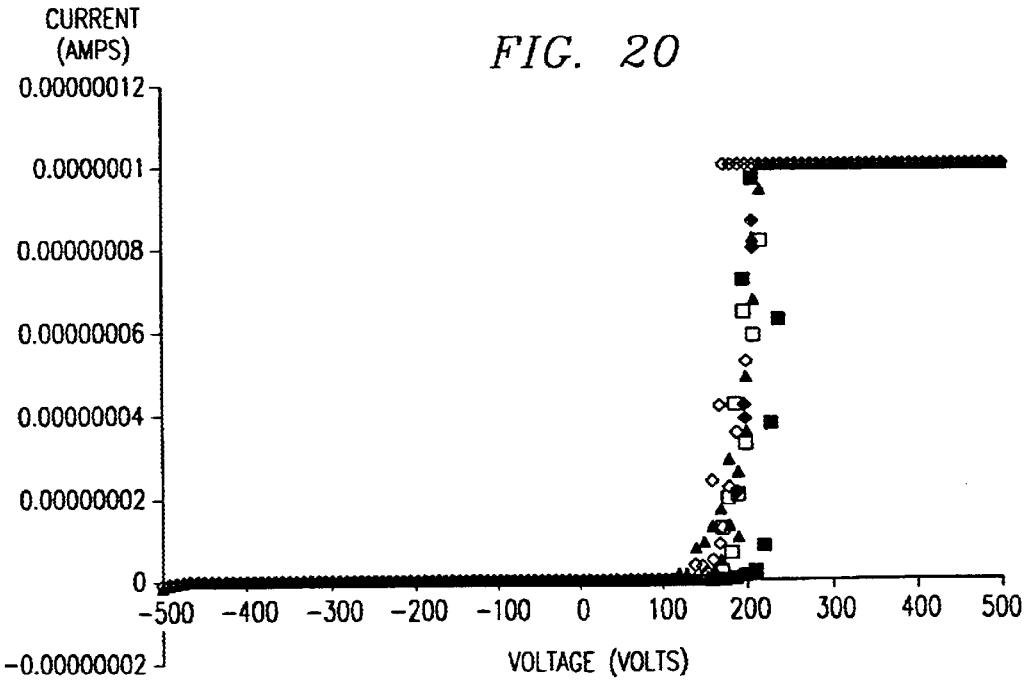
FIGS. 20 through 25 show field emission data taken on a sample deposited at room temperature by laser ablation.
Figure 21:
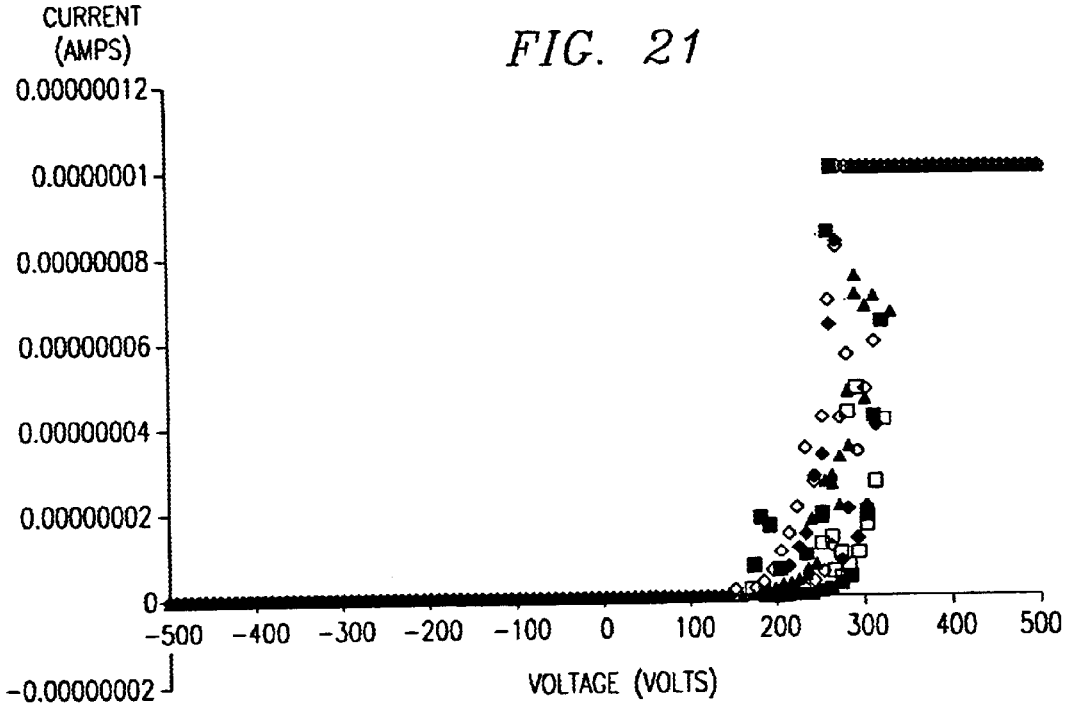
Figure 22:
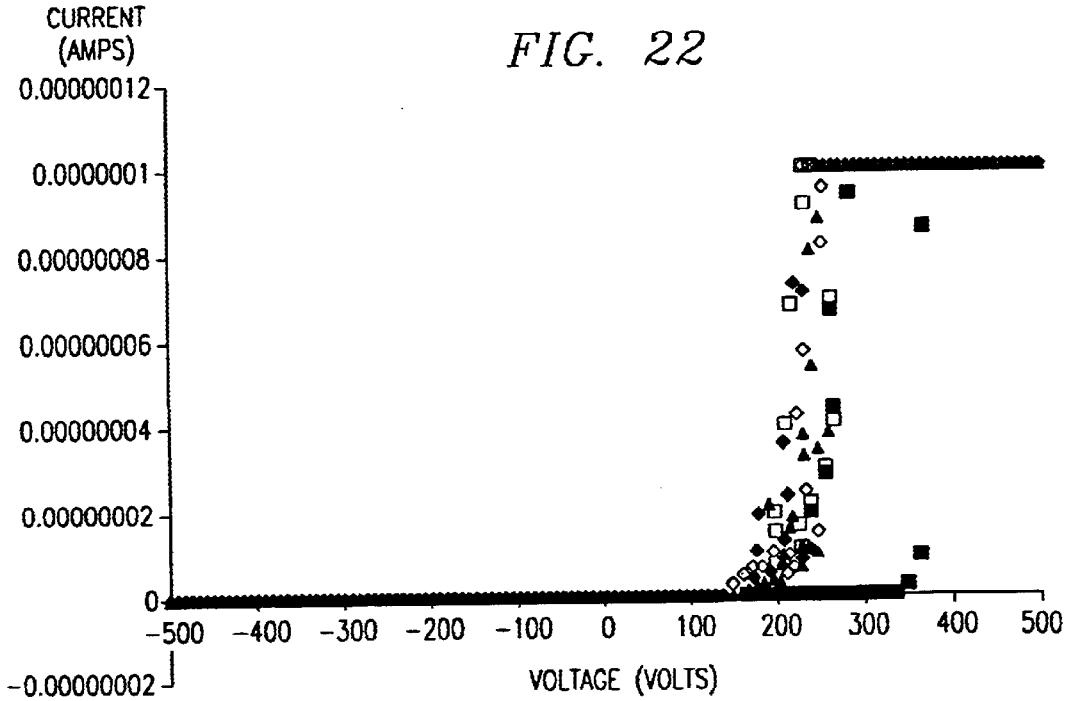
Figure 23:
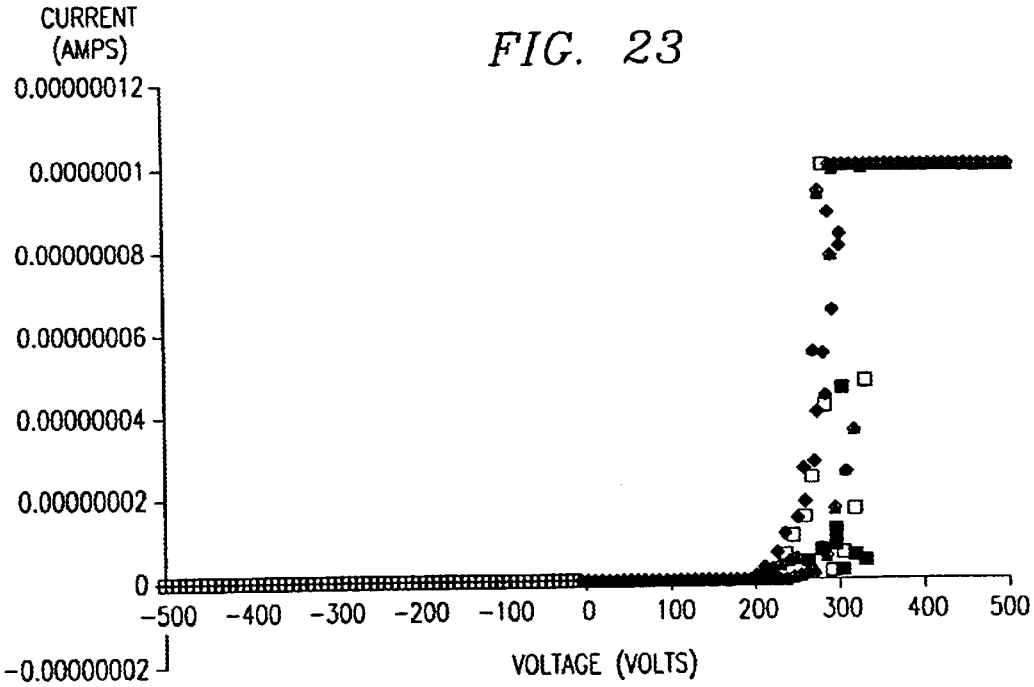
Figure 24:
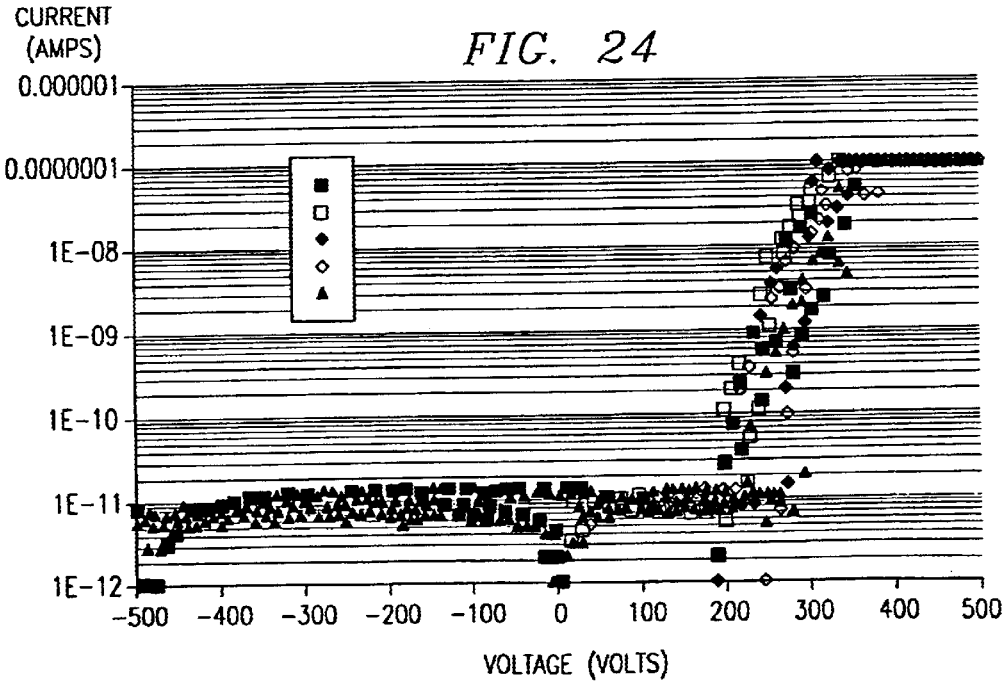
Figure 25:
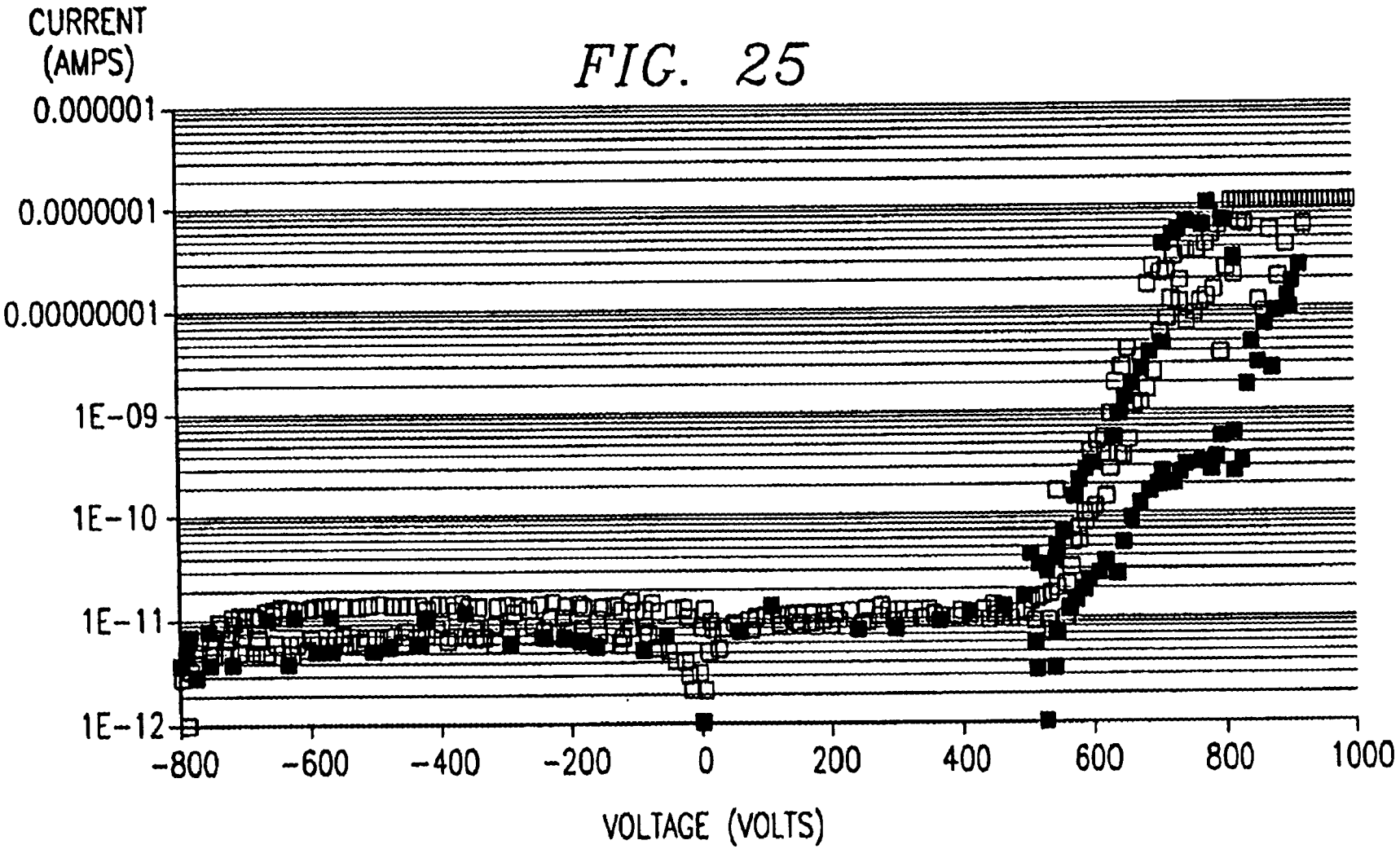

FIG. 15 shows the structure of a sensor with a diamond cathode. The fabrication process is similar to that for vacuum diodes. The only difference is the anode plate 1500. The anode plate 1500, made of a very thin silicon membrane, is deflected by any applied pressure or force, which changes the distance between the anode and the cathode, thereby changing the current which can be measured.

Although direct competition between silicon semiconductor electronics and vacuum electronics based on the field emission cathode is unlikely, the two technologies are not incompatible. It is therefore conceivable that electronic systems incorporating both semiconductor and vacuum devices, possibly even on the same chip, will be possible. Such a hybrid could exploit the high speed of vacuum transport.

In the same chip, solid state devices are made of silicon and vacuum electronics based on non-silicon cathode material. The fabrication process for hybrid chips is very high cost and complicated since two types of the basic material are used and different processes are involved. Diamond possesses a unique combination of desirable properties which make it attractive for a variety of electronics. With the present invention, a chip based on diamond solid state electronics and diamond vacuum electronics is fabricated.

Although the present invention and its advantages have been described in detail, it should be understood that various changes, substitutions and alterations can be made herein without departing from the spirit and scope of the invention as defined by the appended claims.

What is claimed is:

1. A method of making a field emission cathode, comprising the steps of:

depositing a layer of conductive material over a first substrate;

depositing an electrically resistive pillar over said layer of conductive material, said electrically resistive pillar having a substantially flat surface spaced from and substantially parallel to said first substrate;

depositing a layer of cathode material over said surface of said electrically resistive pillar, said layer of cathode material having a substantially flat exposed surface spaced from and substantially parallel to said first substrate;

constructing a plurality of field emission cathodes over said layer of conductive material, said field emission cathodes having interstices therebetween to produce thereby a cathode assembly;

depositing a spacer material in said interstices;

depositing an indium tin oxide layer over a second substrate;

depositing a phosphor film layer over said indium tin oxide layer to produce thereby an anode assembly; and joining said cathode assembly to said anode assembly, said spacer material thereby contacting said phosphor film layer.

2. A method of making a field emission cathode, comprising the steps of:

depositing a layer of conductive material over a substrate;

depositing an electrically resistive pillar over said layer of conductive material, said electrically resistive pillar having a substantially flat surface spaced from and substantially parallel to said substrate;

depositing a layer of cathode material over said surface of said electrically resistive pillar, said layer of cathode material having a substantially flat exposed surface spaced from and substantially parallel to said substrate;

constructing a plurality of field emission cathodes over said layer of conductive material, said field emission cathodes having interstices therebetween to produce thereby a cathode assembly; and depositing a spacer material in said interstices, wherein said spacer material is fibrous.

3. The method as recited in claim 1 wherein said second substrate is glass.

4. The method as recited in claim 1 wherein said joined cathode and anode assemblies form a portion of a flat panel display.

5. The method as recited in claim 4 wherein said joined cathode and anode assemblies are separated by an electrical potential provided by a diode biasing circuit.

* * * * *